US010070741B1

(12) United States Patent
Sofro

(10) Patent No.: US 10,070,741 B1
(45) Date of Patent: Sep. 11, 2018

(54) BEDDING DEVICE AND SYSTEM

(71) Applicant: Elizabeth Sofro, New York, NY (US)

(72) Inventor: Elizabeth Sofro, New York, NY (US)

( * ) Notice: Subject to any disclaimer, the term of this patent is extended or adjusted under 35 U.S.C. 154(b) by 0 days.

(21) Appl. No.: 15/133,943

(22) Filed: Apr. 20, 2016

Related U.S. Application Data

(60) Provisional application No. 62/149,937, filed on Apr. 20, 2015.

(51) Int. Cl.
*A47G 9/02* (2006.01)
*A47G 9/00* (2006.01)

(52) U.S. Cl.
CPC ..... *A47G 9/0261* (2013.01); *A47G 9/0223* (2013.01); *A47G 9/0246* (2013.01); *A47G 9/0238* (2013.01)

(58) Field of Classification Search
CPC ..... A47G 9/02; A47G 9/0207; A47G 9/0223; A47G 9/023; A47G 9/0238; A47G 9/0261
USPC ..... 5/485, 482, 486, 496, 500–502
See application file for complete search history.

(56) References Cited

U.S. PATENT DOCUMENTS 2,736,043 A * 2/1956 Temple ..... A47G 9/0238 5/502
2,810,921 A * 10/1957 Seidenberg ..... A47G 9/0238 5/501
2,832,967 A * 5/1958 Sobel ..... A47G 9/0207 2/69.5
3,241,161 A * 3/1966 Dashosh ..... A47G 9/0261 383/66
3,508,284 A * 4/1970 Marquette ..... A47G 9/023 5/486
3,508,285 A * 4/1970 Marquette ..... A47G 9/023 5/486
3,528,421 A * 9/1970 Vaillancourt et al. ..... A61F 13/534 5/484
3,761,973 A * 10/1973 Leventhal ..... A61F 5/485 5/484
4,021,869 A * 5/1977 Root ..... A47G 9/0246 5/485
4,278,719 A * 7/1981 Sarnecki ..... A47G 9/062 428/78

(Continued)

OTHER PUBLICATIONS http://www.zippysack.com downloaded on Jul. 7, 2016.

*Primary Examiner* — Robert G Santos
(74) *Attorney, Agent, or Firm* — Myers Wolin, LLC

(57) ABSTRACT

A method of assembling a bedding system includes: operatively connecting a first external surface to a second external surface, each surface having a different material construction, the first and second external surfaces being oriented substantially opposite such that they face away from each other; and arranging the external surfaces on a mattress, wherein either external surface faces the mattress so that the opposite external surface faces away from the mattress. The material construction of the first external surface may have a greater thermal conductivity than the material construction of the second external surface. A trim portion may be positioned in plane and facing the same direction as the first external surface, the trim portion having the second material construction and being continuous with the second external surface. When the trim portion and first external surface are arranged facing away from the mattress, an appearance resembling a made bed is provided.

7 Claims, 28 Drawing Sheets

(56) References Cited

U.S. PATENT DOCUMENTS

| | | | | | |
|---|---|---|---|---|---|
| 4,499,131 | A * | 2/1985 | Knox | A61F 5/485 | 428/68 |
| 5,099,531 | A * | 3/1992 | Schmier | A47C 21/022 | 5/494 |
| 6,643,872 | B1 * | 11/2003 | Buswell | A47G 9/0207 | 5/482 |
| 6,862,760 | B2 * | 3/2005 | Bradley | A47G 9/023 | 24/72.5 |
| 7,124,455 | B2 * | 10/2006 | Demarco | A47G 9/023 | 5/482 |
| 7,200,883 | B2 * | 4/2007 | Haggerty | A47G 9/0238 | 5/482 |
| 8,646,133 | B2 * | 2/2014 | Tepper | A47G 9/0261 | 5/485 |
| 2003/0217411 | A1 * | 11/2003 | Bradley | A47G 9/023 | 5/486 |
| 2004/0031098 | A1 * | 2/2004 | Hollander | A47G 9/02 | 5/482 |
| 2005/0268399 | A1 * | 12/2005 | Demarco | A47G 9/023 | 5/486 |
| 2006/0059622 | A1 * | 3/2006 | Haggerty | A47G 9/0238 | 5/486 |
| 2010/0050341 | A1 * | 3/2010 | Tepper | A47G 9/0261 | 5/488 |

* cited by examiner

BEDDING DEVICE AND SYSTEM

CROSS-REFERENCE TO RELATED APPLICATIONS

This application claims the benefit of U.S. Provisional Patent Application No. 62/149,937, filed Apr. 20, 2015, which is incorporated by reference herein.

FIELD

The present disclosure relates generally to bedding systems and more specifically, those systems such as sheets, blankets, or the like directed towards both securely fitting with a corresponding bedding environment such as a mattress and/or systems in a manner where cleaning and bedmaking is efficient.

BACKGROUND

Typical bedding systems may include a sheet set having a top sheet, a fitted sheet that conforms to the mattress, and one or more pillows. With this in mind, parents have been struggling with their children for years to have their children sleep under the top sheet. Because the top sheet tends to have light weight fabric and flexibility, it typically ends up at the foot of the bed in a crumpled into ball, on the ground, or otherwise discarded. Accordingly, there exists a need for a bedding system that avoids being easily discarded while individuals, such as children, are using them while installed on a bedding surface.

Individuals sleeping in the same bed, such as a husband and a wife, have also been known to experience difficulties during sleep when the top sheet is pulled, caught, or otherwise tugged by either or both of the individuals. This can be particularly frustrating at least because it interrupt sleep and create a problem between the individuals. Accordingly, there exists a need to provide a bedding system that allows a sheet and a blanket to remain intact and avoid being caught or tangled by either of the individuals during use.

SUMMARY

The following simplified summary is provided in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In some embodiments, a bedding system may comprise first and second external surfaces. Each external surface has its own distinct material construction. The second external surface may be operatively connected with the first external surface. The first and second external surfaces are oriented substantially opposite such that they face away from each other.

A cavity may be defined between the first and second external surfaces, wherein the cavity may be operable to receive contents such as a duvet cover, a blanket, or other articles to improve thermal conductivity of the bedding system itself. Preferably, the cavity may be releasably sealable along one or more edges or surfaces shared by the first and second external surfaces. The cavity may therefore be releasably sealable with a fastening mechanism, the fastening mechanism including a zipper, a slide mechanism, by being sewn or stitched together, otherwise bonded, or one or more buttons.

In other embodiments, the first and second external surfaces are operatively connected along perimetral surfaces or edges such that the first and second external surfaces are perimetrally connected. The first and second external surfaces may be knit, stitched or sewn together, welded, bonded, or integrally formed with each other. The bedding system may be generally rectangular, rounded, circular, elliptical, polygonal, or triangular.

A continuous perimeter section may optionally be disposed at a shared perimetral edge of the first and second external surfaces. In this embodiment, an attachment mechanism may be operable to securely engage with a mattress. It is to be understood that the mattress may be an inflatable mattress, a twin mattress, a bunk mattress, a full mattress, a queen mattress, a king mattress, or any other mattress known or to be designed. The attachment mechanism of the continuous perimeter section may optionally be constructed from elastic or resilient members operable to conform and snugly fit to the mattress. The bedding system in this embodiment may be a reversible fitted sheet such that when the attachment mechanism of the continuous perimeter securely engages with the mattress, the first or second external surfaces either face away from an upper surface of the mattress or face towards the mattress. The first external surface may have a material construction comprised of knitted fabric and the second external surface may be woven (or vice versa) so that the user can select which surface is preferable depending on, for example, desired thermal conductivity for a given situation.

In this respect, the first material construction associated with the first external surface may have a greater thermal conductivity than a second material construction associated with the second external surface. The first external surface may therefore be knitted such as a blanket surface and the second external surface may be knitted such as a sheet surface.

In a preferred embodiment, the second external surface is defined by a first portion and a second portion, the first portion being oriented opposite the first external surface. The second portion therefore faces the same direction and may be oriented in the same plane with the first external surface, the first portion being substantially larger than the second portion. The first and second portions may share a common width whereas a length of the second portion is approximately 10% or less of a length of the first portion. The second portion may be formed by being folded about a shared edge or surface of the first portion. Accordingly, the bedding system in this embodiment may comprise a trim portion that is integrally formed with the second external surface and having the second material construction, the trim portion facing the same direction as and being oriented in plane with the first external surface. In alternate embodiments, the trim may encompass not only the length but also width and various other designs as desired.

In an alternate embodiment, the first and second portions may be the same size or any of a variety of different miss-matched sizes, such that both the first and second portions may form a folded over trim section on the opposite portion on either or both sides of the length or width as selectively desired.

The first and second external surfaces each have adjoining lower and opposing lateral side edges, the trim portion being disposed opposite the lower edge. The bedding system in this embodiment may be a single combined blanket and top sheet so that when the system is received by a mattress and the trim portion and first external surface are facing away from an upper surface of the mattress, the system has an appearance resembling a made bed.

Optionally, the bedding system can include a cavity for storing a device such as a computing device, a mobile device, a book, a magazine, or a remote control. The cavity may be integrally formed with either of the first or second external surfaces or removable attachable thereto. The first and second external surfaces my optionally include differing design themes, patterns, or colors. These themes, patterns, colors may be formed with the respective surface or removably attachable.

In other embodiments, a reversible sheet and blanket system is provided including a blanket layer adjoined to a sheet layer, the blanket layer being oriented opposite the sheet layer. The sheet layer may be defined by a first portion and a second portion, the first portion being oriented opposite the blanket layer and the second portion being oriented in the same plane with the sheet layer, the first portion being substantially larger than the second portion.

The blanket and sheet layers may be integrally formed with each other or releasably attachable with each other. Optionally, the blanket and/or sheet layers may each comprise a decorative element.

A method of assembling a bedding system may also be provided. The method can include the following steps: operatively connecting a first external surface to a second external surface, each external surface having a different material construction, the first and second external surfaces being oriented substantially opposite such that they face away from each other; and arranging the first and second external surfaces on a mattress, wherein either the first or second external surface faces the mattress so that the opposite external surface faces away from the mattress.

The method may also include connecting the first and second external surfaces along one or more adjoining edges with a fastening mechanism, the fastening mechanism including a zipper, a slide mechanism, or one or more buttons.

The method may also include an attachment mechanism securely engaging the first and second external surfaces to the mattress, the attachment mechanism operable to conform to the mattress. In this respect, the first and second external surfaces and the attachment mechanism may form a reversible fitted sheet. The method may also include orienting either the first or second external surface away from an upper surface of the mattress and orienting the remaining surface towards the mattress. Preferably, the method includes positioning a trim portion in plane and facing the same direction as the first external surface, the trim portion having the second material construction and being continuous with the second external surface. The trim portion and the first and second external surfaces may form a single combined blanket and top sheet, such that the method further includes arranging the trim portion and the first external surface to face away from the mattress to create an appearance resembling a made bed.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

The features of the presently disclosed solution may be economically manufactured or assembled by using two or distinct materials, material combinations and associated components which, may be assembled together for removable or integral application with a known or to-be-designed bedding systems in an economical manner, wherein the features of the present disclosure may form the herein disclosed improved bedding system regardless of the particular form. Unless defined otherwise, all terms of art, notations and other scientific terms or terminology used herein have the same meaning as is commonly understood by one of ordinary skill in the art to which this disclosure belongs.

In some cases, terms with commonly understood meanings are defined herein for clarity and/or for ready reference, and the inclusion of such definitions herein should not necessarily be construed to represent a substantial difference over what is generally understood in the art. All patents, applications, published applications and other publications referred to herein are incorporated by reference in their entirety. If a definition set forth in this section is contrary to or otherwise inconsistent with a definition set forth in the patents, application, published applications and other publications that are herein incorporated by reference, the definition set forth in this section prevails over the definition that is incorporated herein by reference.

As used herein, "a" or "an" means "at least one" or "one or more." As used herein, the term "user", "subject", "end-user" or the like is not limited to a specific entity or person. For example, the term "user" may refer to a person who uses the systems and methods described herein, and frequently may be a field technician. However, this term is not limited to end users or technicians and thus encompasses a variety of persons who can use the disclosed systems and methods.

Figure 1:
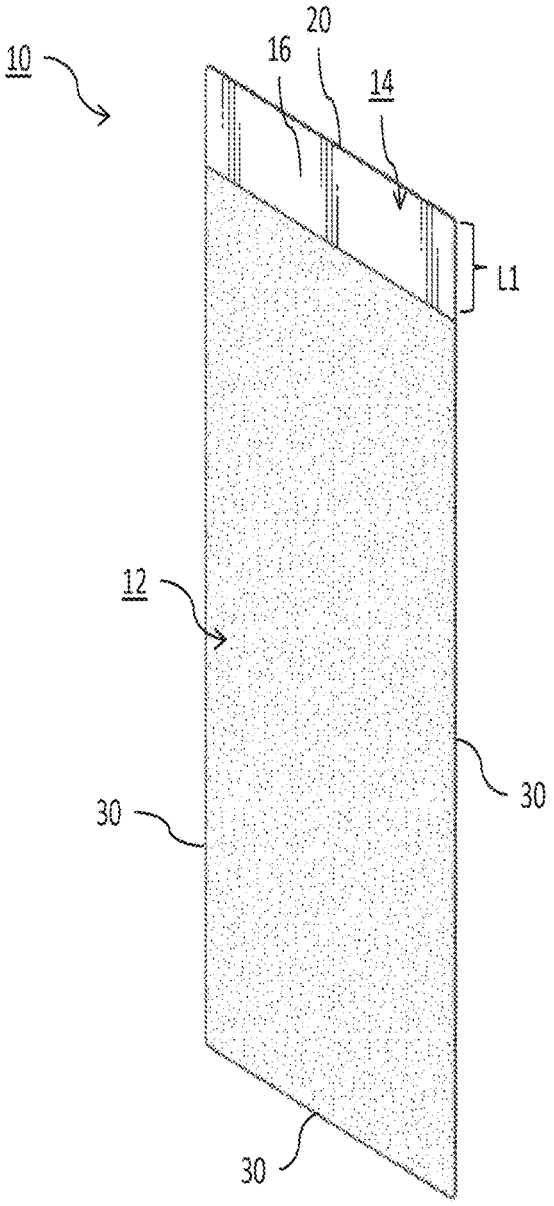
FIG. 1 is a forward perspective view of an exemplary embodiment of a bedding system.
Figure 2:
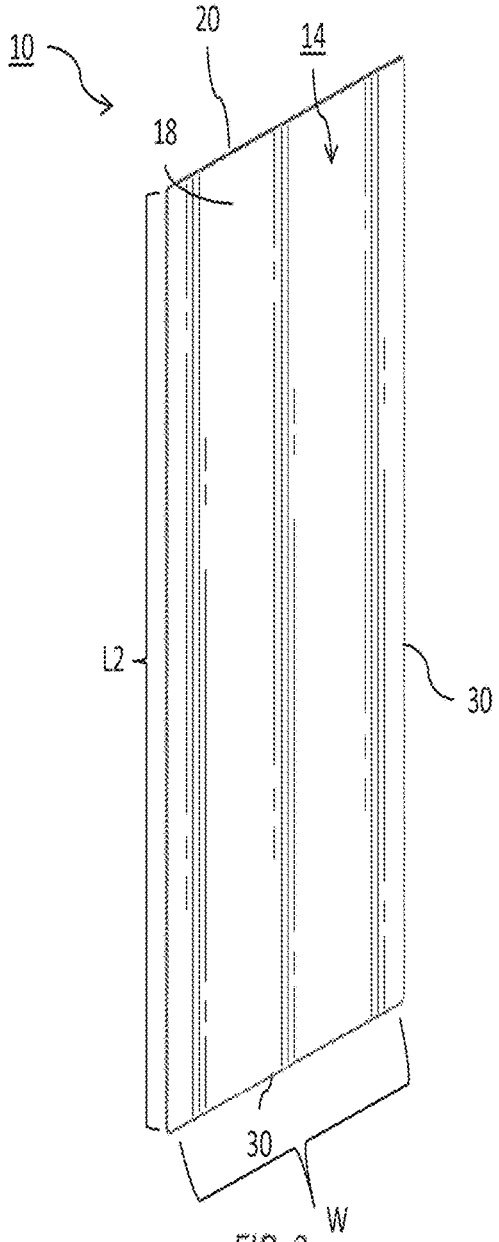
FIG. 2 depicts a rear perspective view of the embodiment of FIG. 1, wherein the system has been rotated so that aft portion is now facing forward.

The disclosed solution can now be better understood turning to the following detailed description. It is to be expressly understood that the illustrated embodiments are set forth as examples and not by way of limitations on the embodiments as ultimately defined in the claims. FIG. 1 depicts a forward perspective view of an exemplary embodiment of a bedding system 10 and FIG. 2 depicts a rear perspective view the same system 10, wherein system 10 has been rotated so that aft portion 18 is now facing forward.

System 10 may be formed by connecting, bonding, welding, sewing, or otherwise operatively coupling a first external surface 12 to a second external surface 14. Alternatively, surfaces 12 and 14 may be integrally formed with each other. Surface 12 may be constructed from a first material construction and surface 14 may be constructed from a second material construction, the first and second material constructions differing in material properties. Each material construction can include single layer fabric or multi-layer fabric, synthetic or natural, with predetermined density, microbial protection, one or more colors, knit, microknit, woven, microfibers, cotton, wool, poly-cotton, polyester, permeable, and/or impermeable.

Preferably the material construction of surface 12 may comprise one or more layers of knitted polyester fabric whereas the material construction of surface 14 may include one or more layers of woven polyester fabric that are relatively lighter than the knitted fabric of surface 12. However, the design is not so limited and as previously stated, either of the surfaces 12 and 14 may be polyester-to-polyester, polyester-to-cotton, cotton-to-cotton, or any other possible combination of materials and fabric construction.

Surfaces 12 and 14 may be connected along one or more adjoining edges or surfaces 30, wherein a cavity may be provided between each surface 12 and 14. The cavity can be operable to receive articles such as one or comforters, a duvet, a blanket, or other articles to increase or affect the thermal conductivity of system 10. Surfaces 12 and 14 can be releasably sealable or fastened along edges 30 through one or more fastening mechanisms including a zipper, a slide mechanism, or one or more buttons. In this respect, surfaces 12 and 14 may be connected along their respective perimeters.

Surfaces 12 and 14 once assembled can take any form according to design need or preference including being substantially rectangular, rounded, circular, elliptical, triangular, or any other shape. Preferably, surfaces 12 and 14 assembled in system 10 take a rectangular form so that they conform and assemble easily with conventional mattresses in the market place. In a preferred embodiment,?

Figure 3:
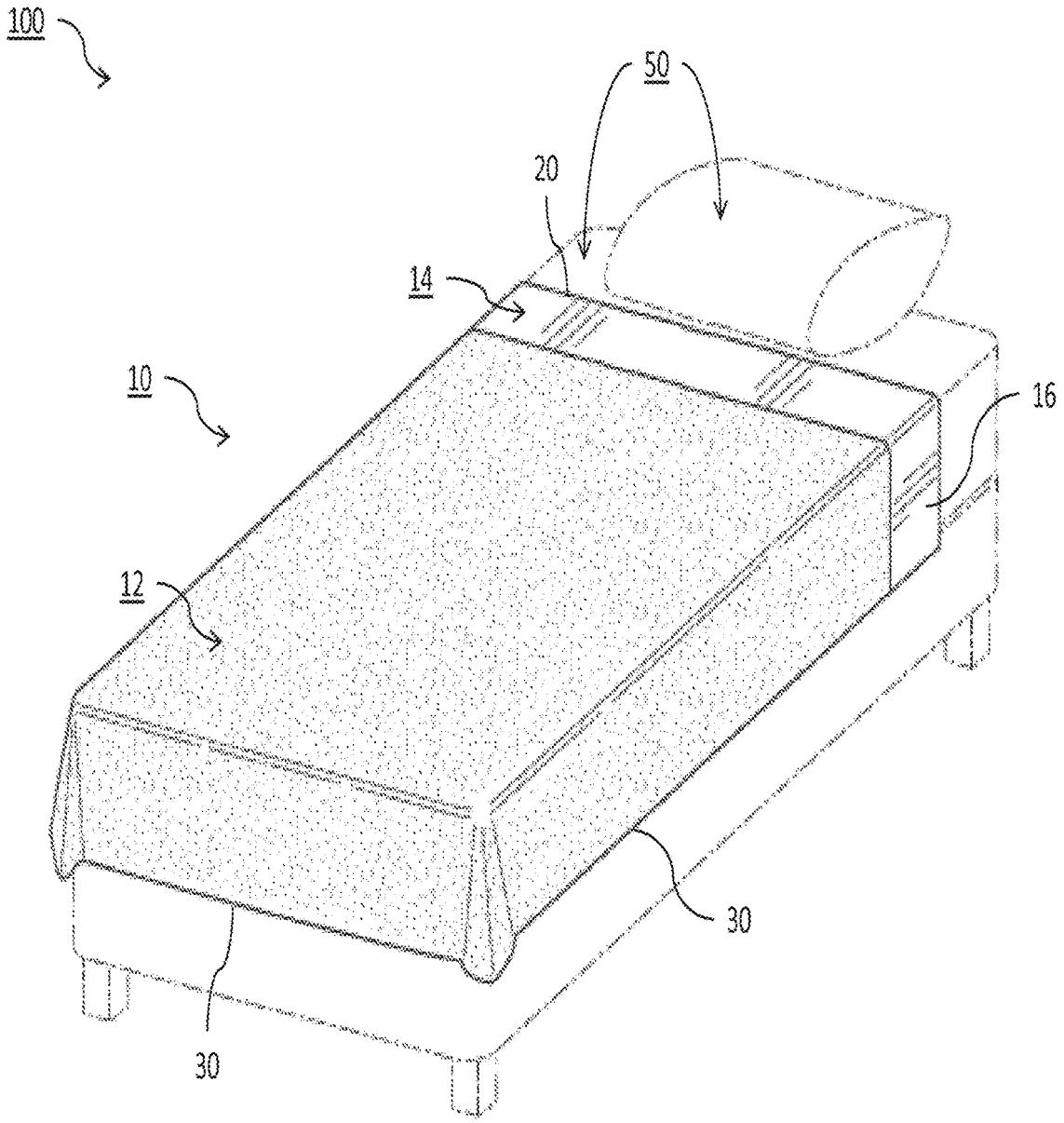
FIG. 3 depicts an exemplary perspective view of the bedding system of FIG. 1 when assembled with a mattress and pillow.

FIG. 3 depicts an exemplary perspective view of bedding system 10 of FIG. 1 when assembled with a mattress and pillow 50. While the mattress and pillow 50 of FIG. 3 illustrate a twin bed arrangement, any size or arrangement can be used with system 10. It can be seen that surfaces 12 and 14 connected together in a single arrangement impart all of the benefits conferred of a top sheet when in use with a blanket but overcomes the problems of articles that are easily dislodged or otherwise messy when used on a bed. Because surfaces 12 and 14 may form system 10 as a single unit, the user benefits from the increased warmth and comfort but with the added benefit of being able to easily make the bed without having to collect, shake out, and otherwise orient multiple sheets and blankets to make the bed. This in turn reduces the frustration previously experienced by parents who struggle to have their young children make their beds after use and/or avoid the sheet or blanket from being dislodged and discarded onto the floor.

In a preferred embodiment, first 12 and second 14 external surfaces can be cuffed and folded over an upper edge 20 of system 10 thereby dividing second external surface 14 into first 18 and second 16 portions. Folding, cuffing, dividing, or otherwise arranging portions 16 and 18 as described may form a trim portion that has the appearance preferably resembling a made bed with a tucked in top sheet. In this respect, first portion 18 may be oriented opposite first surface 12 (see FIG. 2) whereas the second portion 16 may be oriented to face the same direction as surface 12. Accordingly, second portion 16 faces the same direction as surface 12. It can be seen in FIGS. 1-2 that first portion 18 may be substantially larger than second portion 16.

More specifically, it can be seen that portion 16 shares a common width W with surface 12 as well as portion 18. However, portion 16 may have a length L1 that is relatively shorter than length L2 of portion 18. Preferably, length L1 may be 10% or less of the total length L2. However, the design is not so limited and may be any dimension desirable or required for a particular application or mattress size. However, the design is not so limited and may be any dimension desirable or required for a particular application or mattress size. Length L1 may be established by securely engaging, fastening, sewing, or adhering portion 16 to surface 12 as shown in FIG. 1. Length L1 may optionally be adjustable by providing a fastening mechanism on the forward and/or lateral edges such as hook and loop fasteners. This has the advantage of allowing users to define or customize their respective trim portions and associated length L1.

Turning to FIG. 3 shows system 10 assembled with conventional mattress and pillow 50. It can be seen that first 18 and second 16 portions of surface 14 assemble over the top 20 of the surface 12 which preferably is a blanket layer in a manner that imparts the appearance and functionality of a bed that is made. This is because material constructions associated with the first 12 and second 14 external surfaces differ to the extent that combining, connecting, or otherwise adhering first 12 and second 14 external surfaces to each other along adjoining surfaces or edges 30 ensures that two layers that do not normally stay together. The trim portion formed between portions 16 and 18 specifically give the appearance of a snugly fit top sheet with a blanket on mattress 50.

System 10 in this respect is particularly advantageous for sleepovers with children, wherein parents are able to send their children with system 10 which avoids having to send multiple articles and risk articles being discarded, wasted, or left behind. It also ensures that the children remain sufficiently warmed since both the top sheet and blanket of their system 10 remains intact throughout use. System 10 also avoids the common struggle or fight that emerges when multiple individuals are using a bedding system since system 10 is not subject to being undone or discarded because it is a single, formed system. Simply put, system 10 provides the function that allows for multiple desirable sheets, blankets, or comforters to remain together as one article.

System 10 is also particularly advantageous since it gives the consumer the convenience and appearance of a made bed without the hassle of a top sheet ending up in a wrinkled, wadded up or otherwise discarded the foot of the bed or on the floor. They disclosed system 10 is also advantageous since it allows for children and college students alike to make their beds with relative ease by carrying one simple task. This is because simply shaking the disclosed system 10 and re-arranging on a bedding surface (e.g. mattress 50) provides an appearance and function of a made bed all in one product thereby removing the need for a separate top sheet, blanket, and the like.

System 10 is also beneficial for many individuals including children and their parents. This is because it is common for children of all ages to leave a bed unkempt or otherwise toss and discard sheets leaving their beds to look messy. The herein disclosed bedding system 10 solves this by ensuring that a top sheet and the blanket can remain connected while also maintaining a predetermined trim portion arranged uniformly. Certain service providers are also well-suited to benefit from the herein disclosed bedding system. Such service providers may include hospitals, hotels, spas, college students, cruise ships, and camps. Stated otherwise, any location and/or service provider that has a bed or sleeping surface would benefit from the herein disclosed bedding system.

Figure 4:
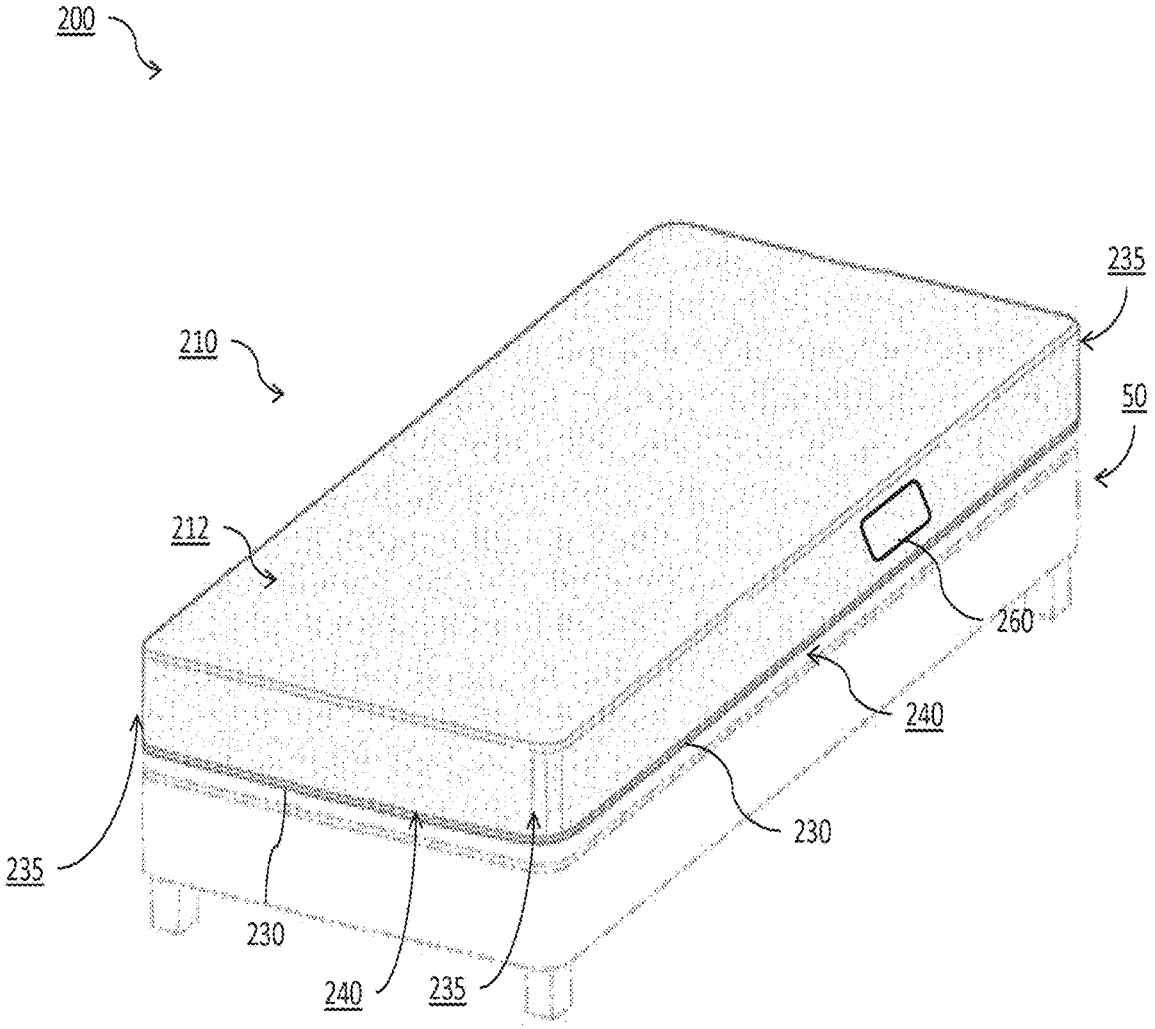
FIG. 4 depicts another bedding system with a continuous perimeter surface between the adjoining external surfaces when assembled with a mattress and pillow.

FIG. 4 depicts another bedding system 210 when assembled with the above-described exemplary mattress 50 as assembly 200. System 210 can be seen including first 212 and second 214 external surfaces, wherein surfaces 212 and 214 in this embodiment may be adjoined or otherwise connected along a continuous perimeter section 230. Section 230 may be defined by perimetral edges shared by surfaces 212 and 214 when assembling surfaces 212 and 214 with each other to form system 210. Section 230 may include an attachment mechanism 240 operable to securely engage with mattress 50.

The attachment mechanism 240 may be formed from one or more elastic bands or member capable of being stretched to conform and fit over the mattress much as a fitted sheet. The attachment mechanism 240 may include stretchable material disposed in the one or more corners 235 of system 210 and/or be disposed internal to section 230, wherein the stretchable material can include any elastomeric materials, rubber, or even segmented polyurethane. Mechanism 240 may therefore be encapsulated, surrounded, disposed within, or otherwise received by the same material in corners 235 and/or section 230 in material constructions associated with surfaces 212 and/or 214. Corners 235 may likewise include any fabric or material that may not be elastic such as a non-elastomeric yarn that can be knitted to form the fabric corners 235, with one possibly advantageous non-elastomeric yarn being comprised of polyester.

The attachment mechanism 240 itself may be constructed from the second material construction, the first material construction, or from its own unique material construction distinct from the first and second material constructions associated with surfaces 212 and 214. Similar to system 10, system 210 may be reversible such that the user has the option of having surface 212 or 214 face upward to receiver user(s) during use. For example, surface 212 may have a first thermal conductivity (a sheet surface) and surface 214 may have a second thermal conductivity that is greater than that of surface 212 (a blanket surface). If the user wishes to have a bedding sheet with a warmer surface during winter months, the user may select surface 212 to be oriented facing upwards. By contrast, if the user wishes to have a bedding sheet with a colder surface during summer months, the user may selected surface 214 to be oriented facing upwards. In those embodiments specific to children, either of surfaces 212 or 214 may be impermeable or include an impermeable member disposed therebetween to protect corresponding mattress 50 from unwanted or undesirable liquid waste during use.

Optionally, cavity 260 may be provided externally positioned on either of surfaces 212 or 214. Cavity 260 may be removably attachable to either of surfaces 212 or 214 with hook and loop fasteners or may be integrally formed thereto. Preferably, cavity 260 would be positioned along perimetral lateral surfaces that are externally accessible by the user when resting in system 210 when assembled on mattress 50. Cavity 260 may be operable to receive a device such as a computing device, a mobile device, a book, a magazine, or a remote control.

Figure 5:
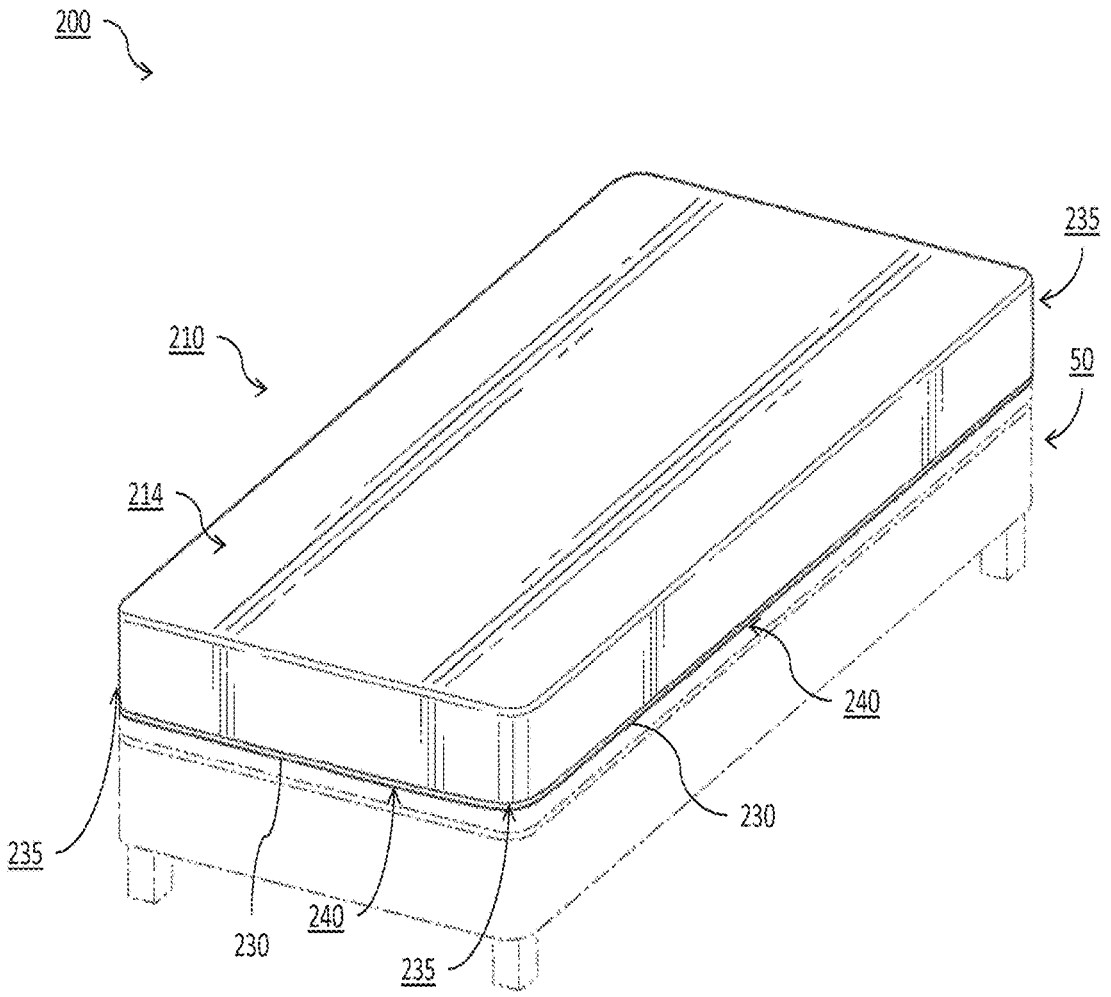
FIG. 5 depicts the system of FIG. 4, wherein the system has been rotated so that the outer external surface of FIG. 4 is now facing the mattress.

FIG. 5 depicts system 210 but with surfaces 212 and 214 having been reversed now with surface 214 facing upwards. Thus, system 210 is reversible since either of surfaces 212 or 214 can be oriented to face upwards and be in contact with a user during use. This is particularly advantageous since surfaces 212 and 214 with their respective differing material constructions and associated properties can be used and selected by a user according to design need or preference (e.g. depending on if the ambient air is hot or cold or depending on if the user desires a particular color, pattern, or sensation associated with either of surfaces 212 or 214).

Figure 6:
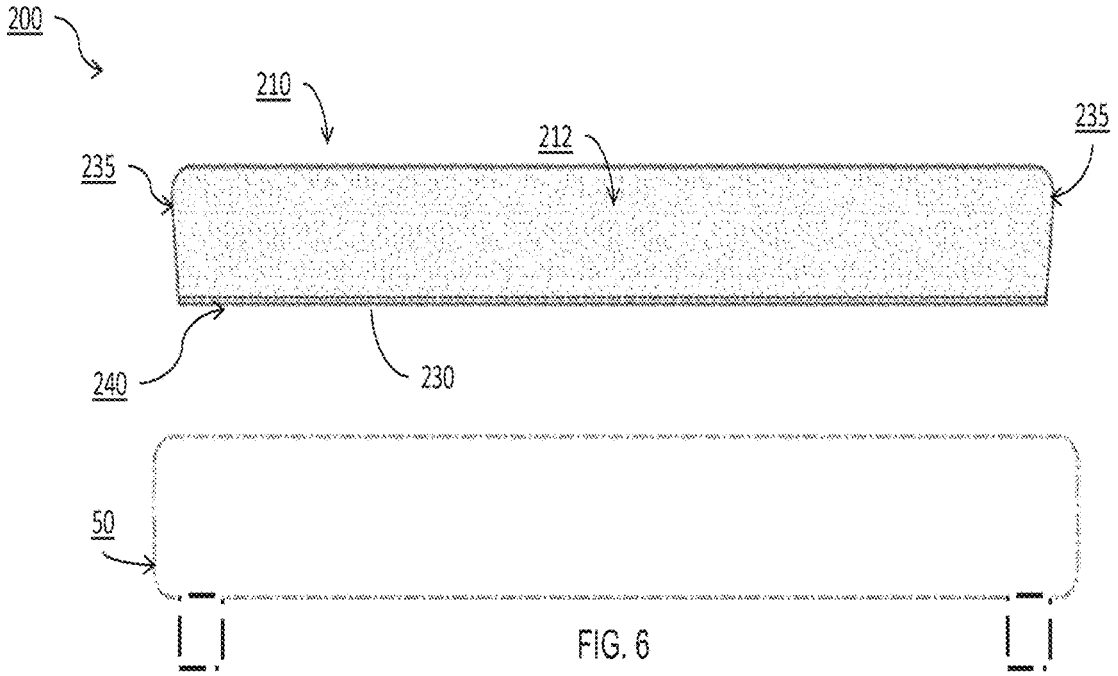
FIG. 6 is a side plan view of the bedding system of FIG. 4 prior to be assembled with an exemplary mattress.
Figure 7:
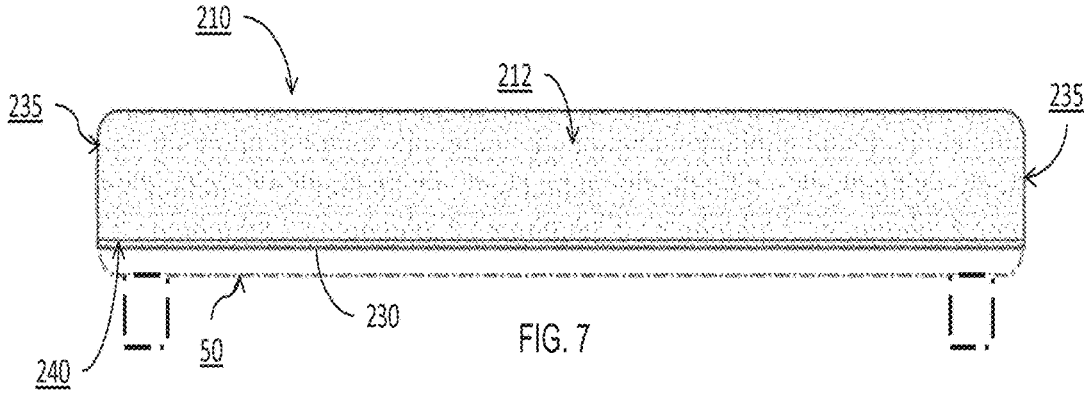
FIG. 7 is a side plan view of the bedding device after being adjusted and assembled with the mattress.
Figure 8:
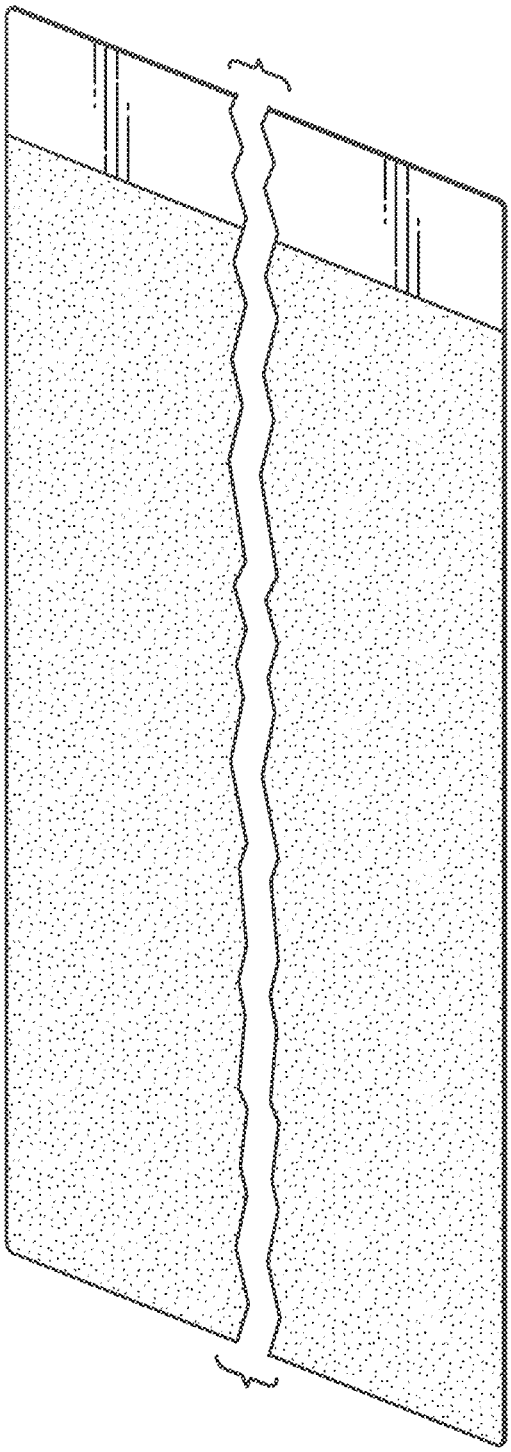
FIG. 8 is a top perspective view of a multi-textured reversible bedding device, showing the design.
Figure 9:
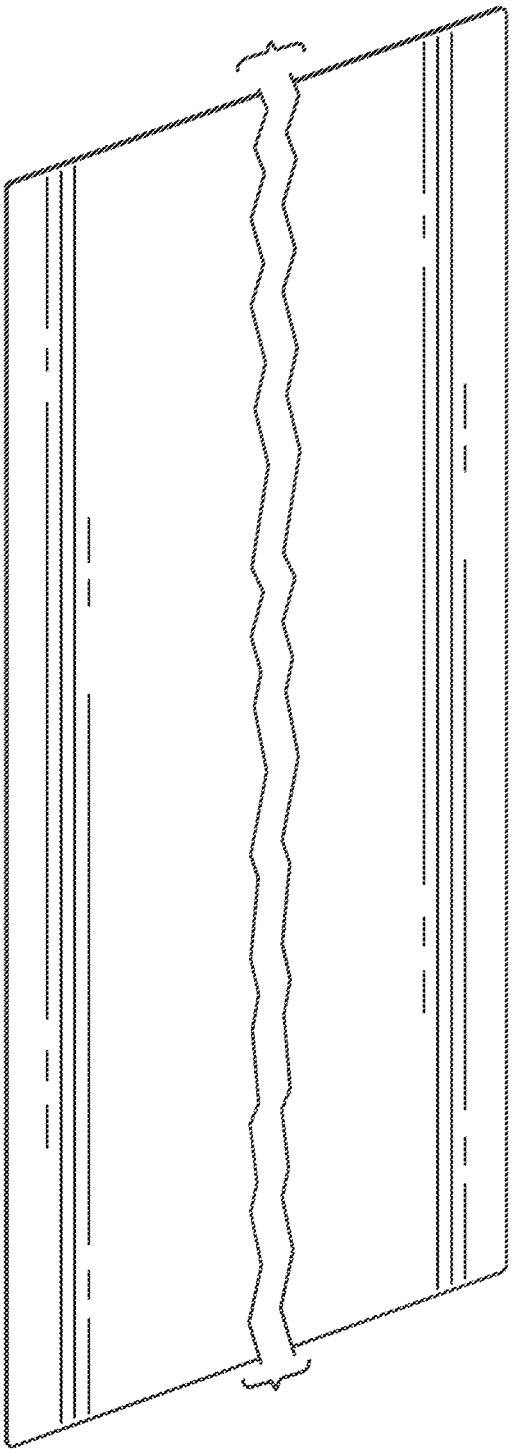
FIG. 9 is a bottom perspective view showing the multi-textured reversible bedding device of FIG. 8.
Figure 10:
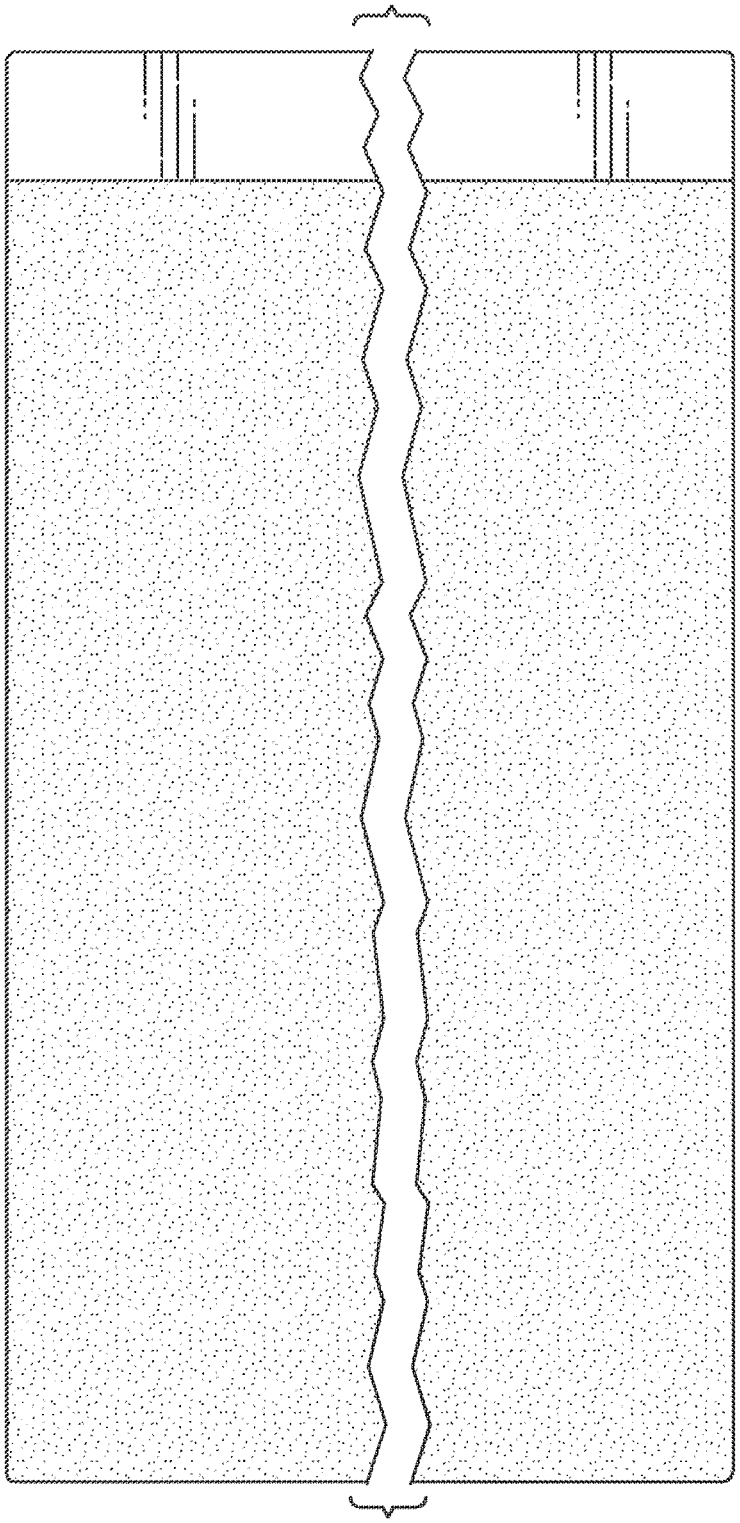
FIG. 10 is a top plan view of the multi-textured reversible bedding device of FIG. 8.
Figure 11:
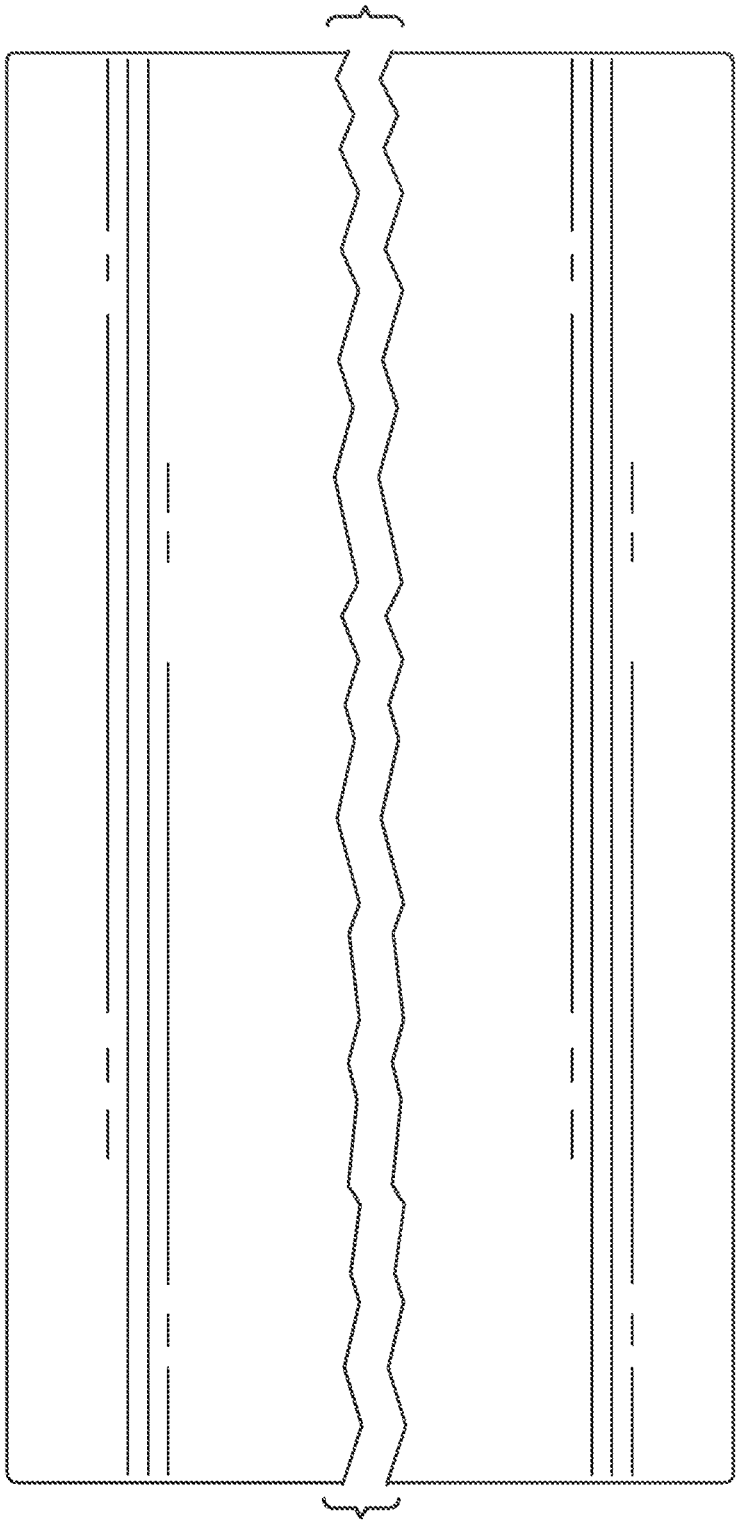
FIG. 11 is a bottom plan view of the multi-textured reversible bedding device of FIG. 8.
Figure 12:
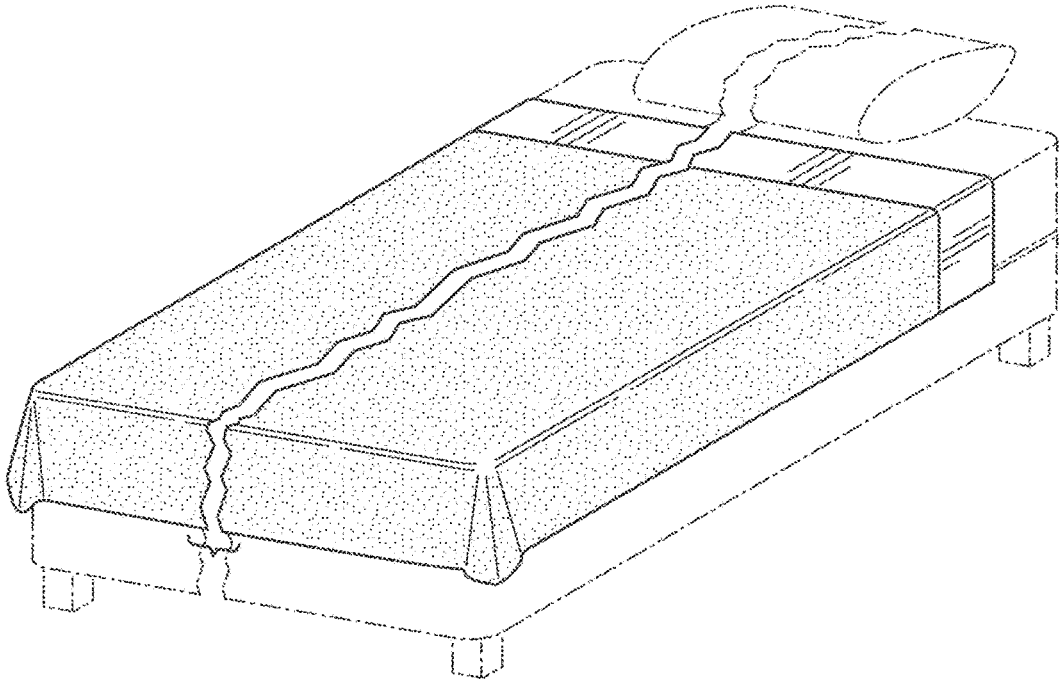
FIG. 12 is a top perspective view of the multi-textured reversible bedding device of FIG. 8 shown as if fitted on an exemplary mattress for illustrative purposes.
Figure 13:
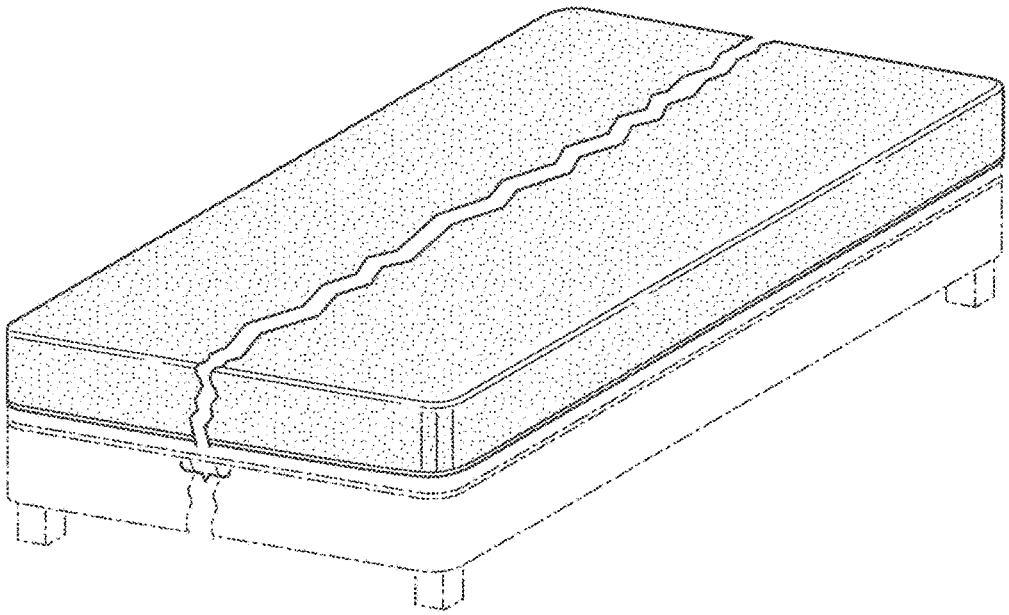
FIG. 13 is a top perspective view of a multi-textured reversible bedding device shown as if fitted on another exemplary mattress for illustrative purposes.
Figure 14:
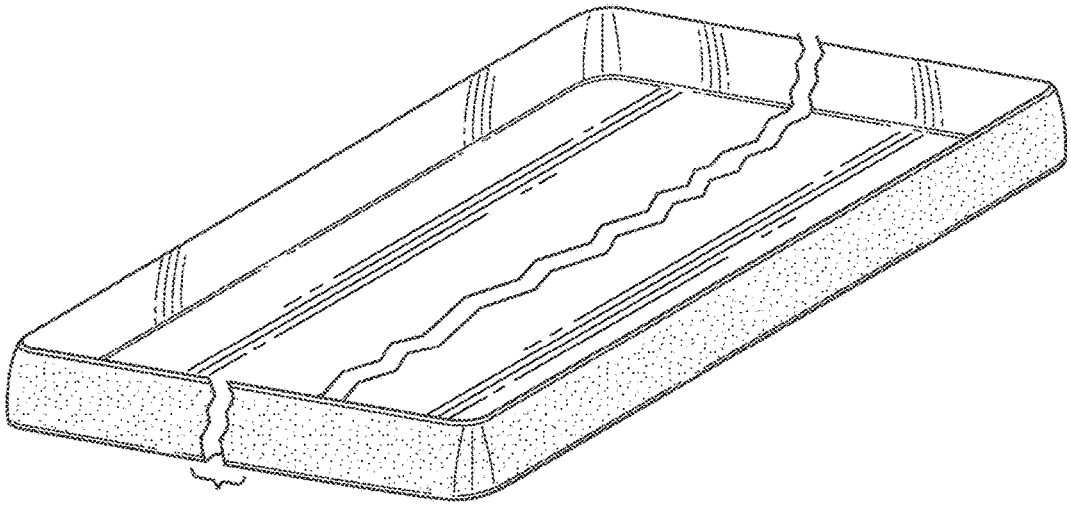
FIG. 14 is a perspective view of the multi-textured reversible bedding device, wherein the multi-textured reversible bedding device is rotated from FIG. 13 showing its internal surface.
Figure 15:
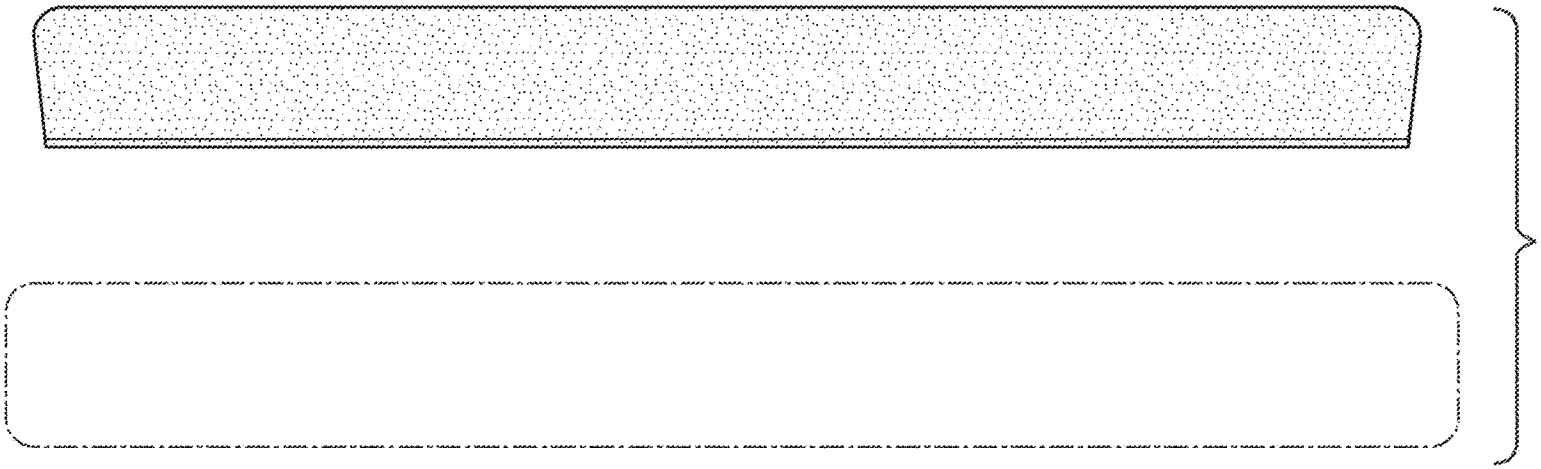
FIG. 15 is a side plan view of the multi-textured reversible bedding device prior to be assembled with the mattress.
Figure 16:
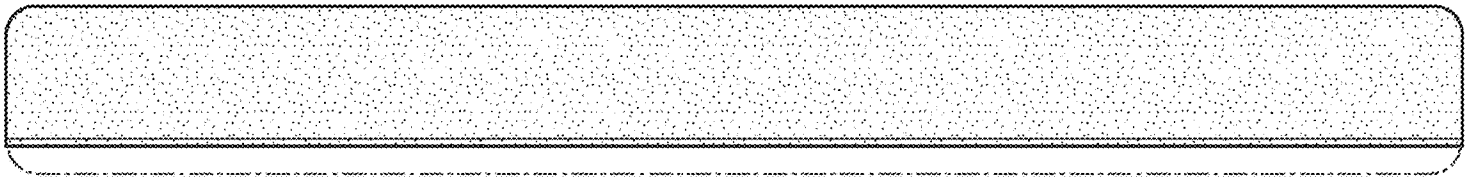
FIG. 16 is a side plan view of the multi-textured reversible bedding device after being stretched and assembled with the mattress.
Figure 17:
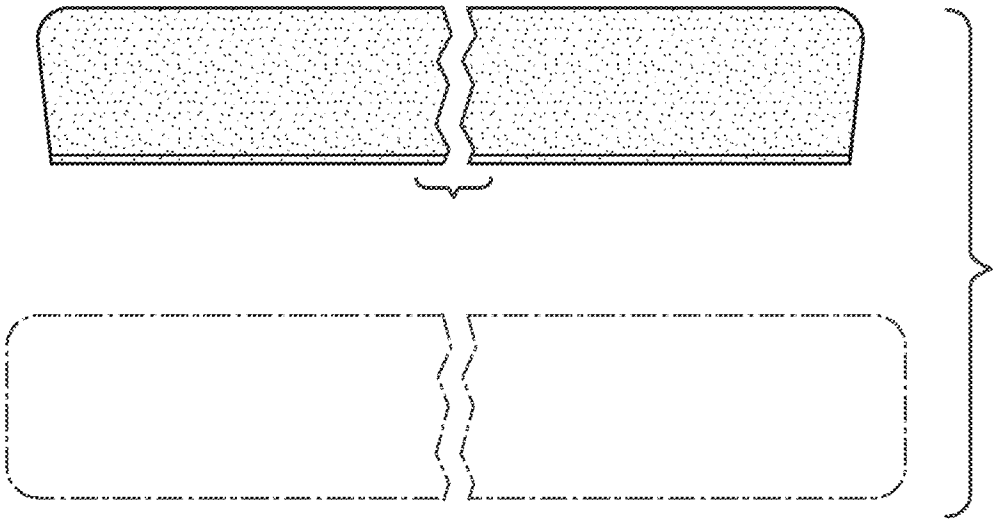
FIG. 17 is a front plan view of the multi-textured reversible bedding device prior to being assembled with the mattress.
Figure 18:
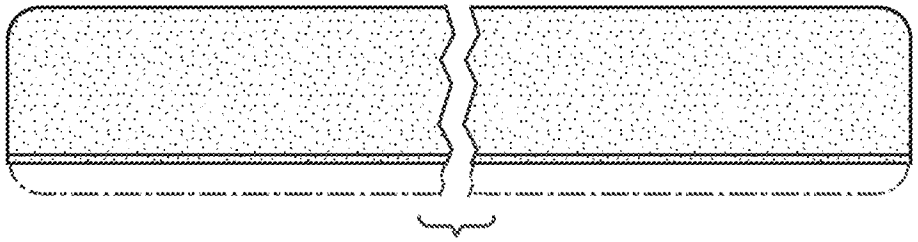
FIG. 18 is a front plan view of the multi-textured reversible bedding device after being stretched and assembled with the mattress.
Figure 19:
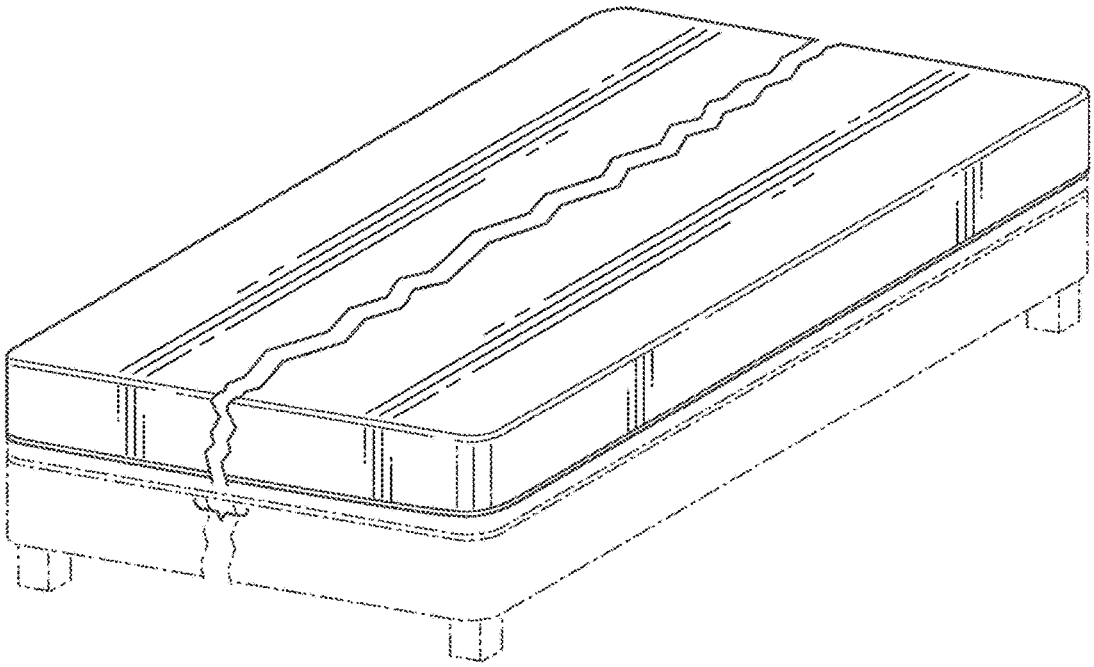
FIG. 19 is a top perspective view of the multi-textured reversible bedding device shown as if fitted on the exemplary mattress for illustrative purposes, the internal surface has been reversed and faces away from the exemplary mattress.
Figure 20:
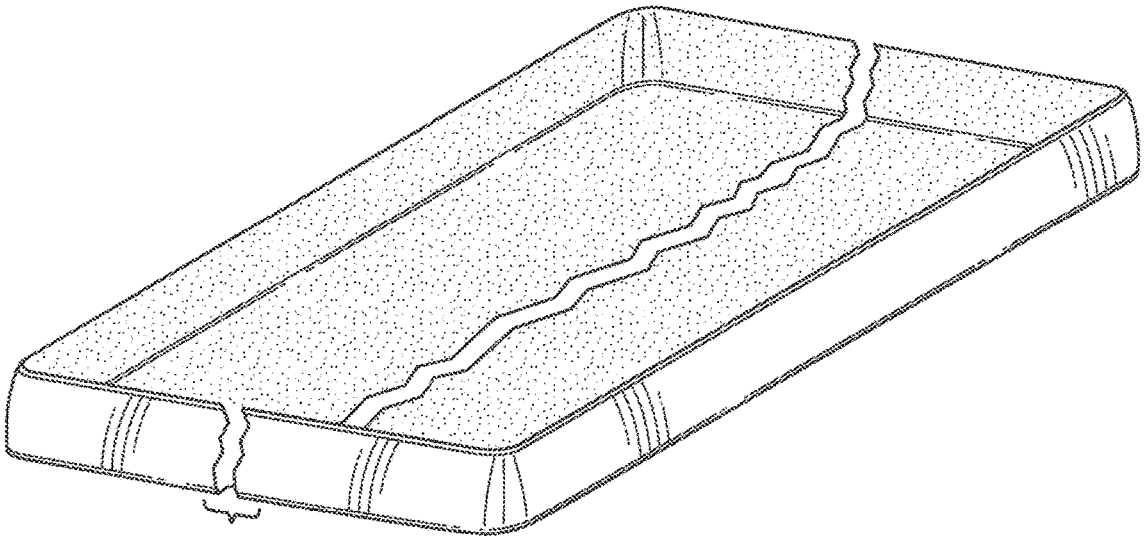
FIG. 20 is a perspective view of the multi-textured reversible bedding device, wherein the multi-textured reversible bedding device is rotated from FIG. 12 showing its now externally positioned internal surface.
Figure 21:
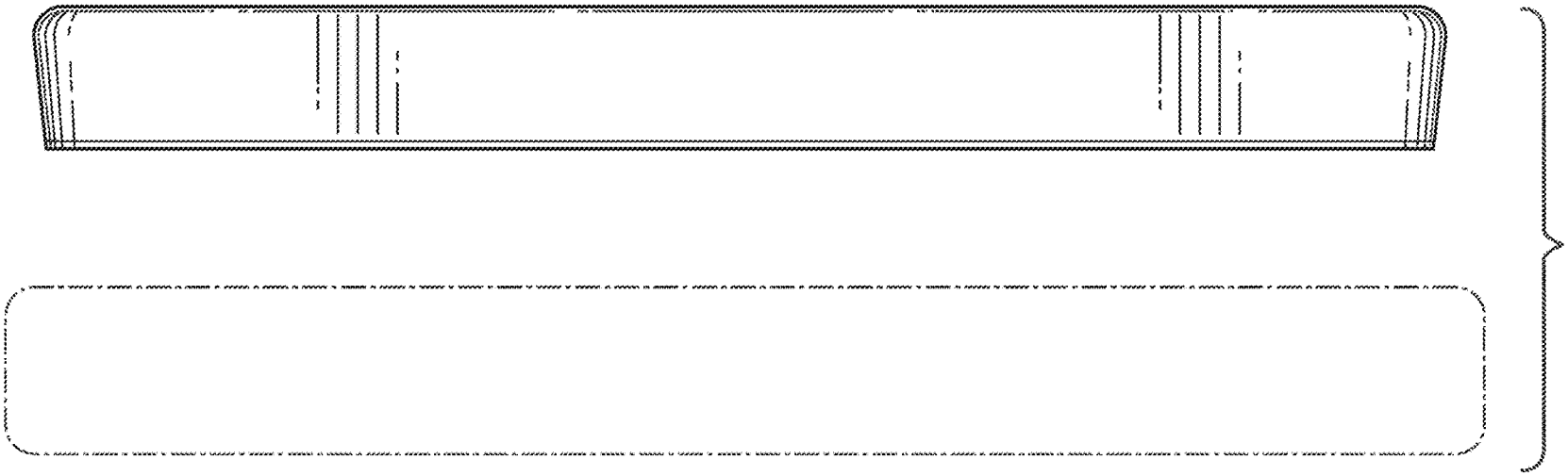
FIG. 21 is a side plan view of the multi-textured reversible bedding device with the externally positioned internal surface prior to be assembled with the mattress.
Figure 22:
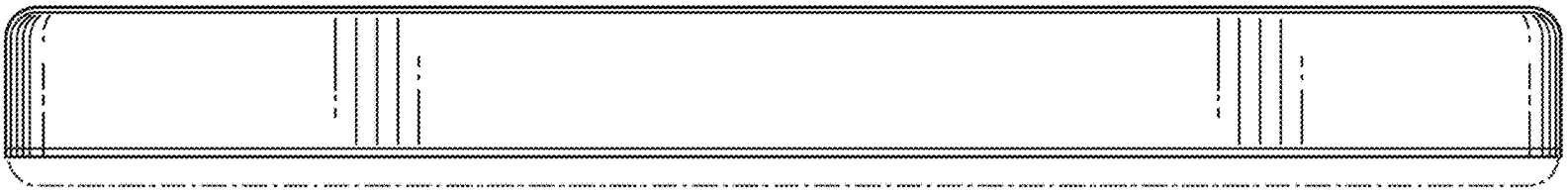
FIG. 22 is a side plan view of the multi-textured reversible bedding device with the externally positioned internal surface after being stretched and assembled with the mattress.
Figure 23:
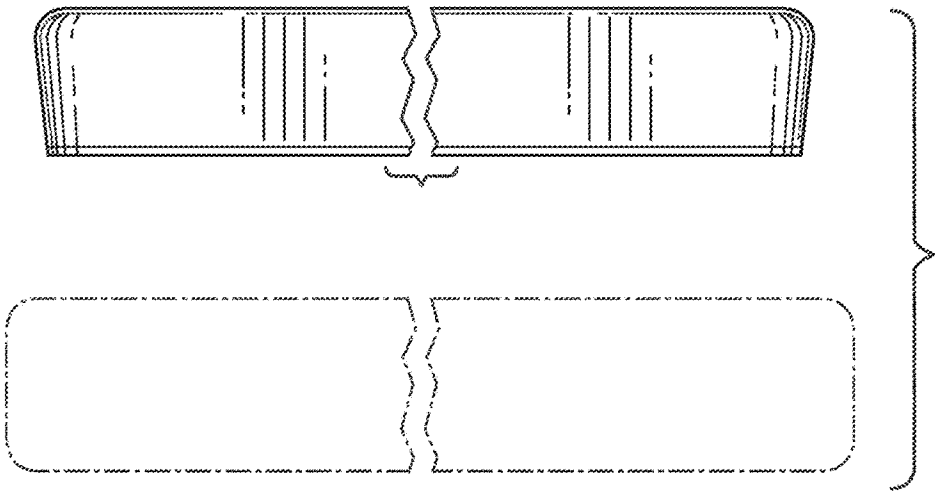
FIG. 23 is a front plan view of the multi-textured reversible bedding device with the externally positioned internal surface prior to be assembled with the mattress.
Figure 24:
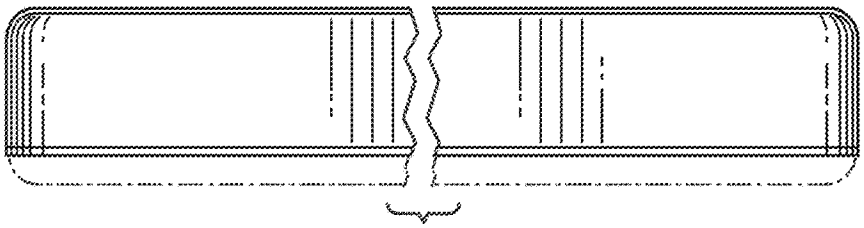
FIG. 24 is a front plan view of the multi-textured reversible bedding device with the externally positioned internal surface after being stretched and assembled with the mattress. The multi-textured reversible bedding device is shown with a symbolic break in its width to indicate indeterminate length. The appearance of any portion of the article between the break lines forms no part of the design.
Figure 25:
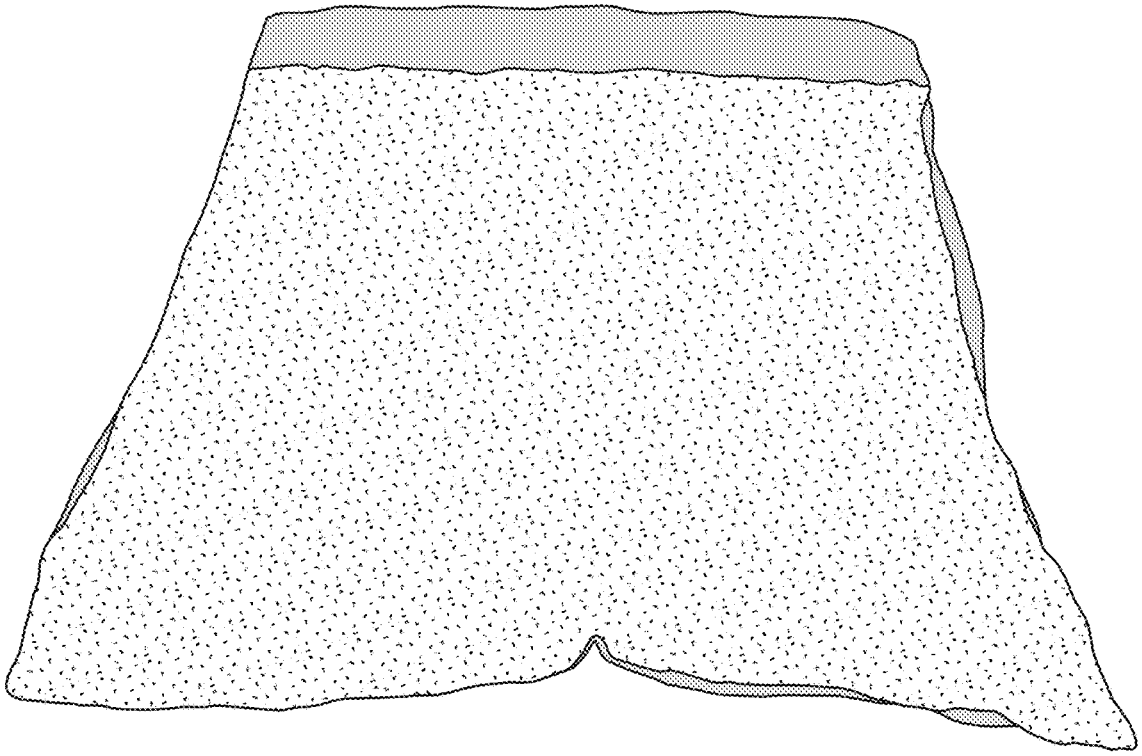
FIGS. 25-31 are photographs of various embodiments of bedding systems in accordance with this disclosure.
Figure 26:
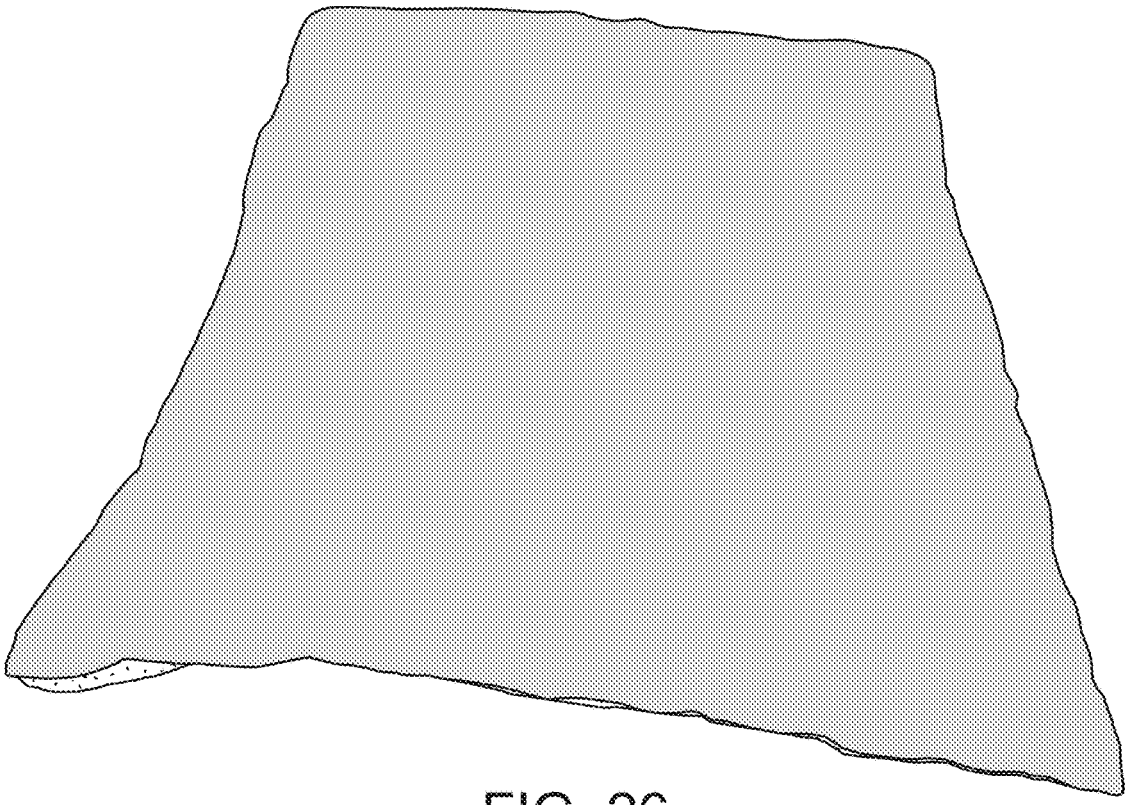
Figure 27:
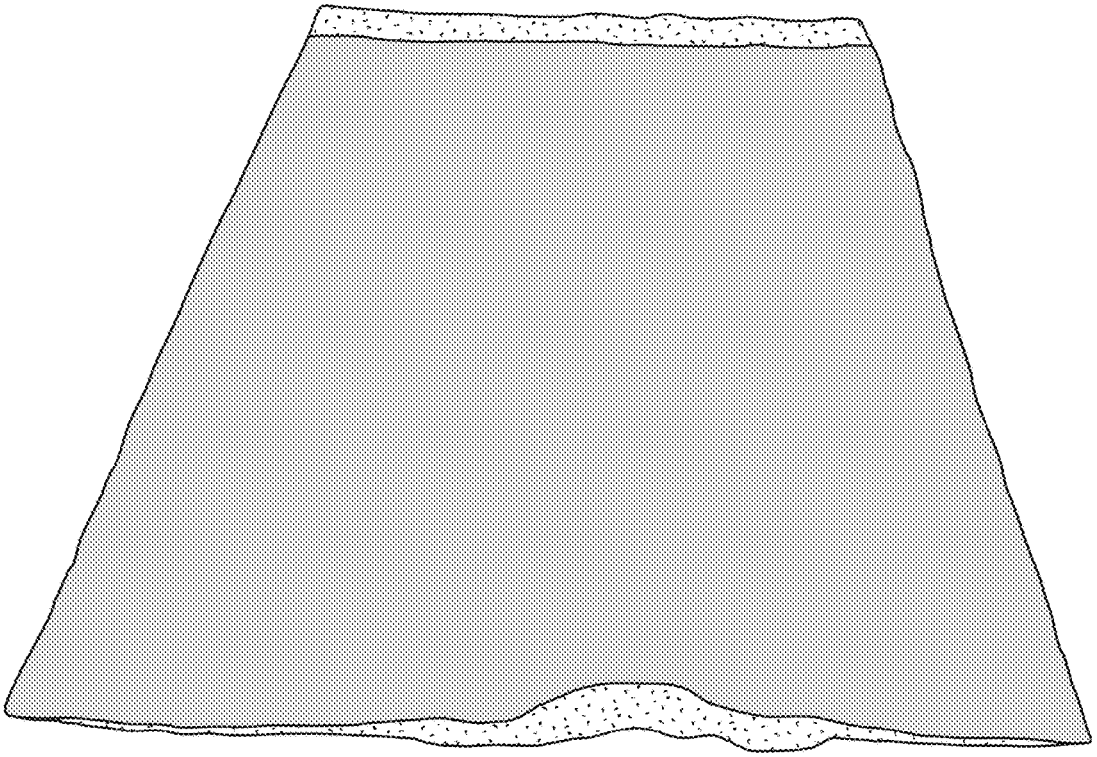
Figure 28:
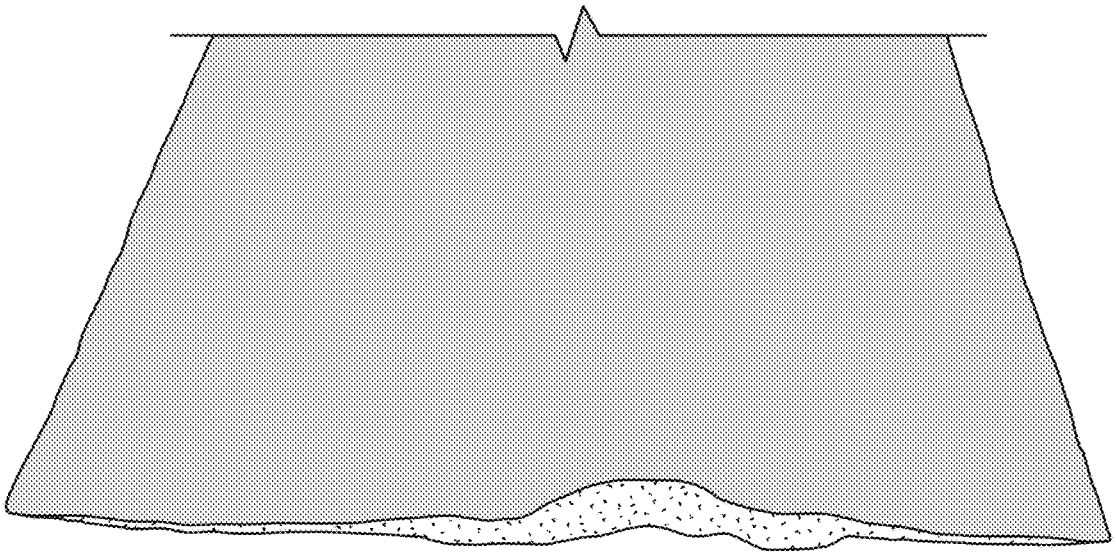
Figure 29:
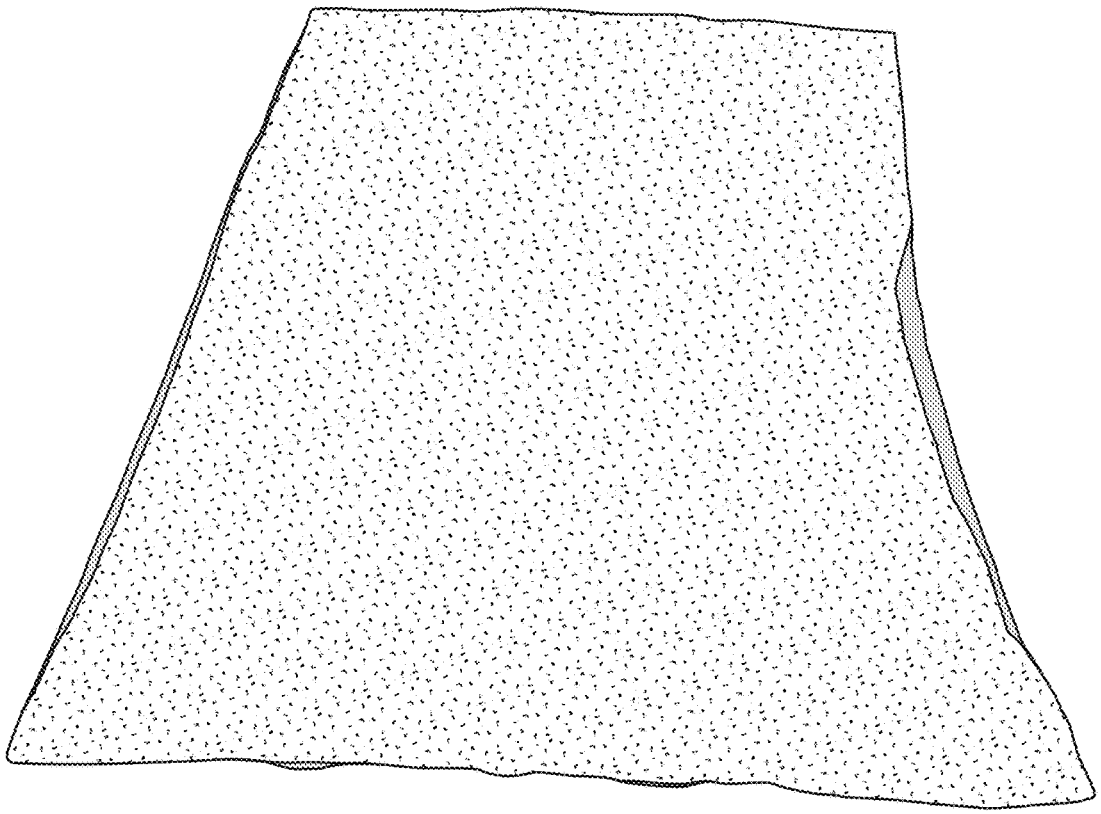
Figure 30:
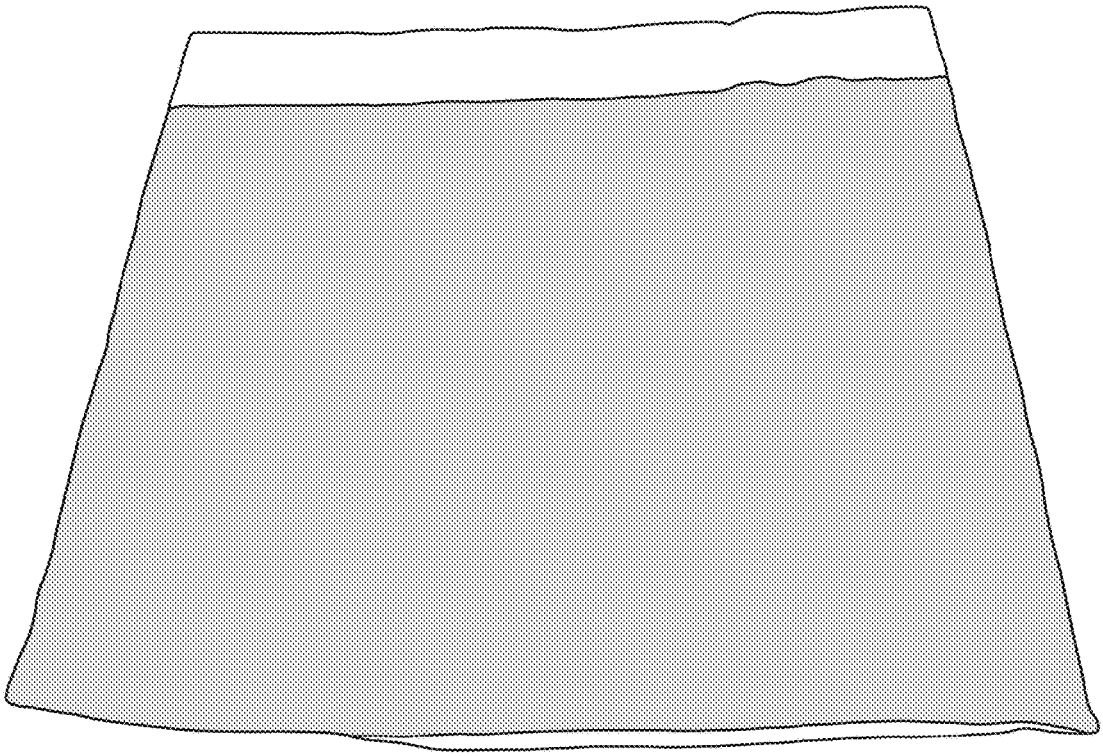
Figure 31:
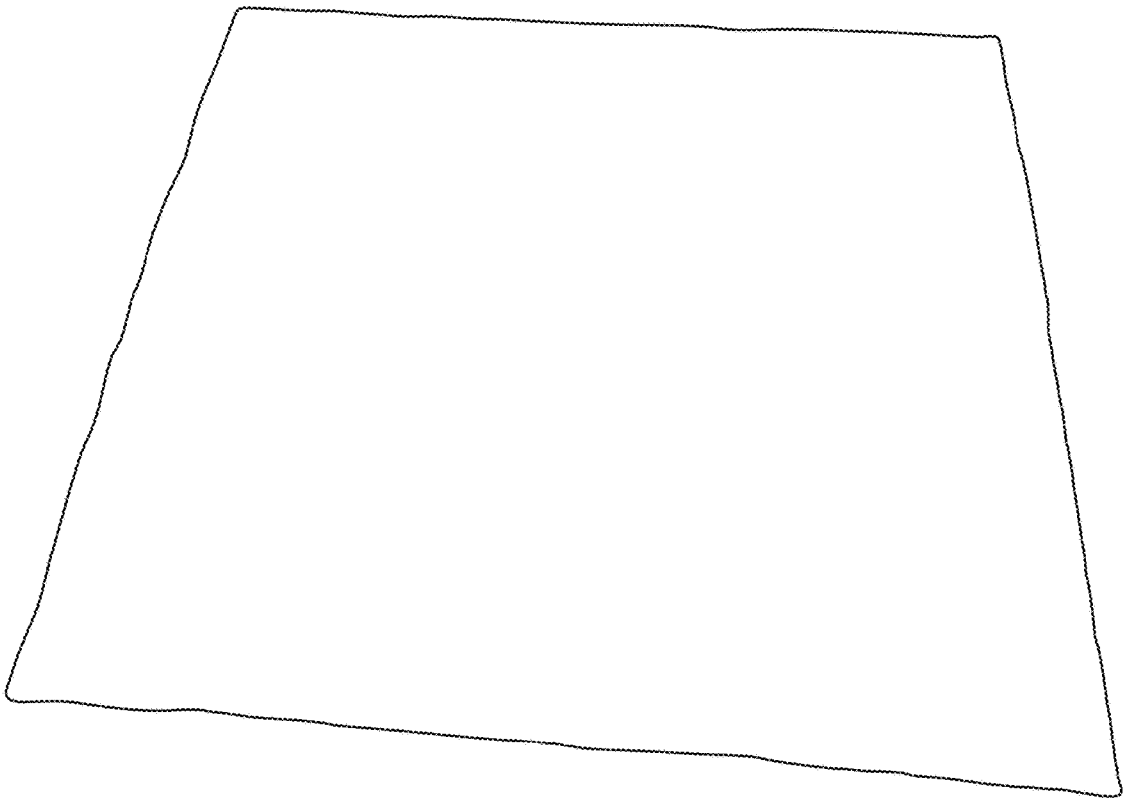
Figures 32, 33:
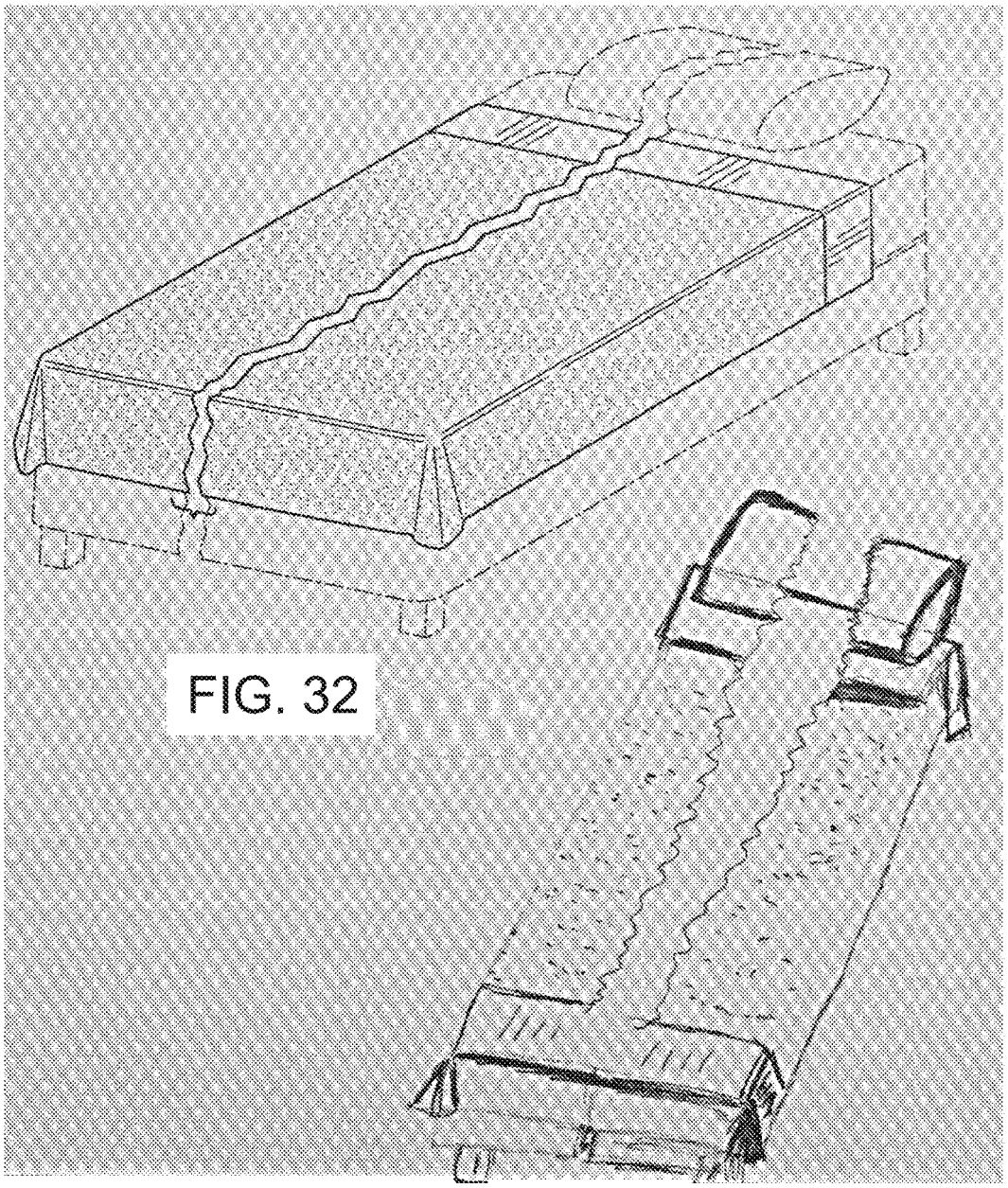
FIGS. 32 and 33 demonstrate that the bedding systems of this disclosure may be provided in various widths for different size beds.
Figure 34:
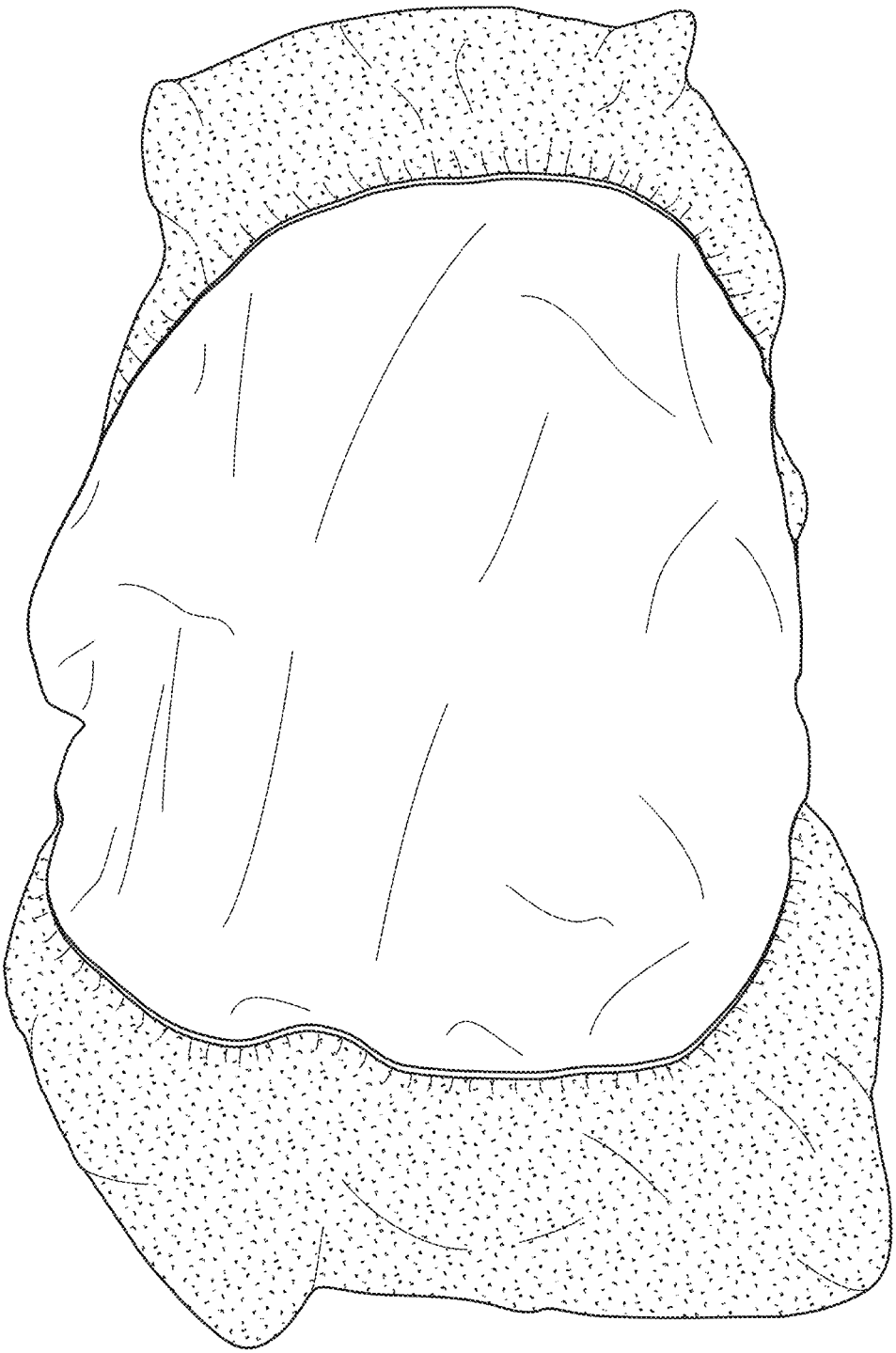
FIGS. 34 and 35 illustrate fitted versions of bedding systems in accordance with this disclosure.
Figure 35:
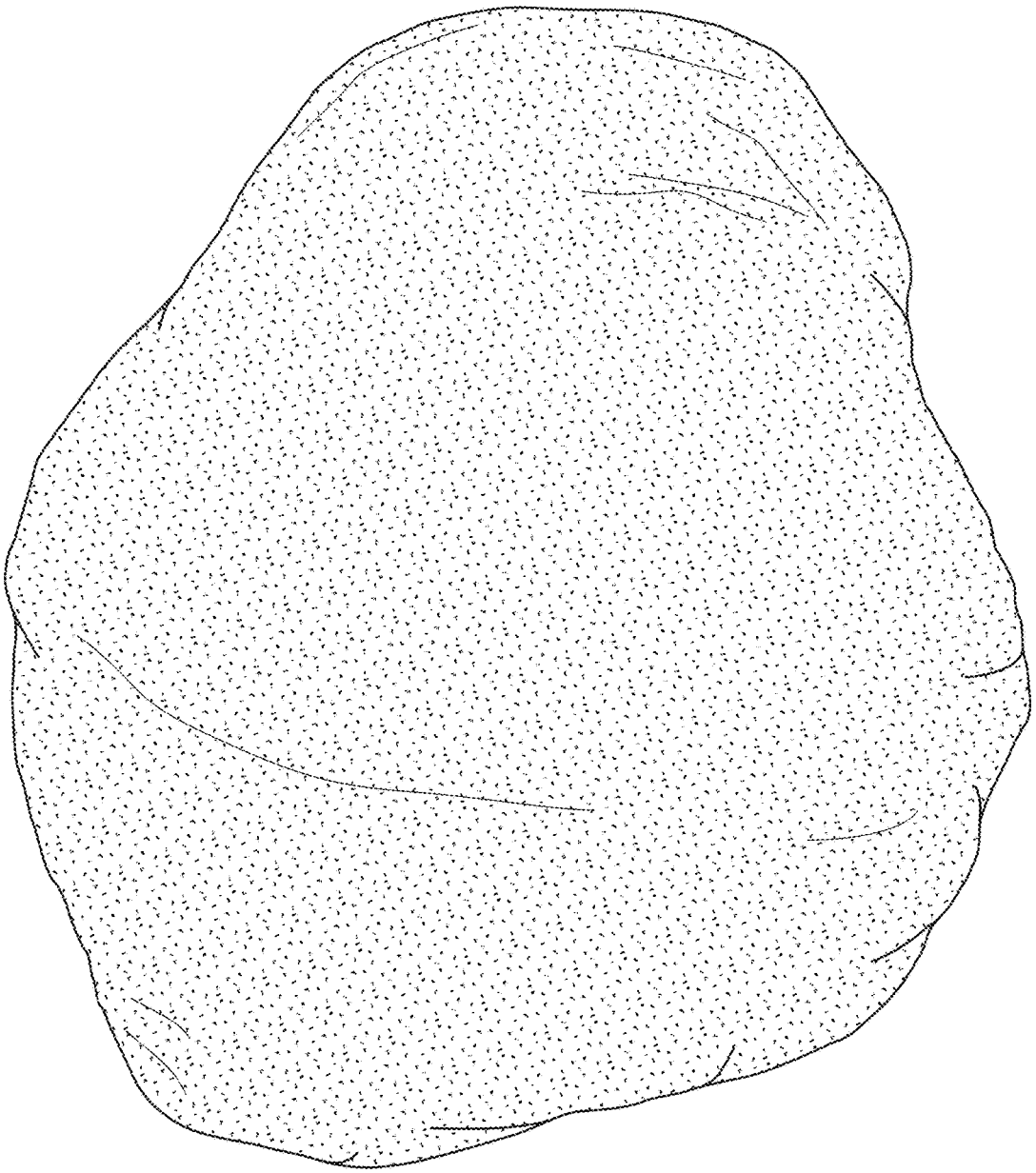

FIGS. 6 and 7 depict similar side views of system 210 with exemplary mattress 50. Specifically, FIG. 6 illustrates a side plan view of system 210 with surface 212 oriented facing outwards. It should be noted that since system 210 is reversible, surface 212 may be arranged so that it faces mattress 50 and corresponding surface 214 faces outward. Turning back to FIG. 6, it can be seen that section 230 appears to be smaller relative to corresponding mattress 50. In FIG. 7, section 230 with mechanism 240 is elongated, stretched, or otherwise adjusted to conform to mattress 250 and impart a snug fit for system 210 with mattress 50 to form system 200.

Either of systems 10 or 210 may optionally include one or more themes, colors, patterns, or other decorative element. For example, a favorite character from a movie, comic book, or cartoon may be included on surface 12 and a different character may be included with surface 14. This decorative element may be integrally formed in the respective material construction of either surface 12 or 14 or may be removably attachable thereto. In this respect, either of systems 10 or 210 may be included in a deliverable kit that comprises a plurality of removably attachable decorative elements. These decorative elements may be attachable by way of fastening mechanisms that include buttons, one or more zippers, hook and loop fasteners, straps, or the like.

Since the user of the external surfaces of the herein disclosed bedding systems 10 or 210 may contain differing material properties such as differing thermal conductivity, the disclosed bedding systems are particularly advantageous in picnic or beach settings. In this respect, if the user wishes to have a surface or layer with higher thermal conductivity such as a knit surface (e.g. blanket), then the user can choose to have this surface facing upwards to rest on during use. By contrast, if it's hot outside and the user wishes to have a cooler resting surface, then the user can choose to rest on the opposing, second external surface with a lower thermal conductivity such as a woven surface (e.g. a sheet).

Finally, systems 10 and 210 also provide unique thermal control to the user experience attributed to the external surfaces and their distinct material constructions. For example, the user has the ability to select and customize the thermal nature of their sleeping experience by being able to select or adjust a preferred thermal conductivity of a particular material construction depending on if the user wishes to be relatively warm or cool during use.

Many alterations and modifications may be made by those having ordinary skill in the art without departing from the spirit and scope of the embodiments disclosed and described herein. Therefore, it is understood that the illustrated and described embodiments have been set forth only for the purposes of examples and that they are not to be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A bedding apparatus comprising:

a first external surface comprising a first material and having a first length; and a second external surface opposite the first external surface comprising a second material different than the first material and having a second length shorter than the first length, wherein an extension of the first external surface extending beyond the second length folds over an edge of and is fixed to the second external surface forming an overlapping length of the first external surface facing the same direction as the second external surface, wherein the first and second external surfaces are perimetrically connected, and wherein the first and second external surfaces face away from each other, and further comprising an internal cavity between the first and second external surfaces, wherein the internal cavity is accessible through a releasably connected portion of the perimeter of the first and second external surfaces.

2. The bedding apparatus of claim 1 wherein the first material has a first thermal conductivity, and the second material has a second thermal conductivity greater than the first thermal conductivity.

3. The bedding apparatus of claim 1 wherein each of the first and second external surfaces are substantially rectangular, and wherein three sides of the first and second external surfaces are permanently connected and a fourth side is releasably connected.

4. The bedding apparatus of claim 1 further comprising a removable blanket within the internal cavity.

5. The bedding apparatus of claim 1 wherein the second external surface further comprises a plurality of fixation points for mating with a fixation edge of the first external surface, and wherein fixation of the fixation edge to a first of the plurality of fixation points results in a first overlapping length and fixation of the fixation edge to a second fixation point results in a second overlapping length different than the first overlapping length.

6. The bedding apparatus of claim 1 wherein the first external surface is a sheet and the second external surface is a blanket.

7. A bedding apparatus comprising:

a first external surface comprising a first material and having a first length; and a second external surface opposite the first external surface comprising a second material different than the first material and having a second length shorter than the first length, wherein an extension of the first external surface extending beyond the second length folds over an edge of and is fixed to the second external surface forming an overlapping length of the first external surface facing the same direction as the second external surface, wherein the second external surface further comprises a plurality of fixation points for mating with a fixation edge of the first external surface, and wherein fixation of the fixation edge to a first of the plurality of fixation points results in a first overlapping length and fixation of the fixation edge to a second fixation point results in a second overlapping length different than the first overlapping length.

* * * * *